US006931228B2

(12) United States Patent
Tanaka et al.

(10) Patent No.: US 6,931,228 B2
(45) Date of Patent: Aug. 16, 2005

(54) IMAGE-FORMING APPARATUS INCLUDING INSPECTION AND STORAGE OF DEVELOPING DEVICES

(75) Inventors: Hiroshi Tanaka, Nagano-ken (JP); Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 108 days.

(21) Appl. No.: 10/298,231

(22) Filed: Nov. 18, 2002

(65) Prior Publication Data

US 2003/0095804 A1 May 22, 2003

(30) Foreign Application Priority Data

Nov. 19, 2001 (JP) ..... 2001-353684
Nov. 19, 2001 (JP) ..... 2001-353685
Dec. 7, 2001 (JP) ..... 2001-374825

(51) Int. Cl.[7] ..... G03G 15/01; G03G 15/00
(52) U.S. Cl. ..... 399/227; 399/13; 399/119
(58) Field of Search ..... 399/12, 13, 226, 399/227, 119

(56) References Cited

U.S. PATENT DOCUMENTS 5,579,088 A * 11/1996 Ko ..... 399/12
5,862,430 A * 1/1999 Mitekura et al. ..... 399/227
6,104,898 A * 8/2000 Awano et al. ..... 399/119
6,192,211 B1 * 2/2001 Kimura ..... 399/227
6,204,866 B1 * 3/2001 Yonenaga
6,266,492 B1 * 7/2001 Maehara ..... 399/12
6,546,212 B1 * 4/2003 Ogata et al. ..... 399/12
2002/0021906 A1 * 2/2002 Yoshizaki et al. ..... 399/12
2003/0012576 A1 * 1/2003 Owen et al.

FOREIGN PATENT DOCUMENTS

JP 06067484 A * 3/1994 ..... G03G/15/00

* cited by examiner

*Primary Examiner*—Susan Lee
(74) *Attorney, Agent, or Firm*—Sughrue Mion, PLLC

(57) ABSTRACT

The present invention provides a highly-reliable image-forming apparatus. The image-forming apparatus includes an image carrier and a plurality of holders. A latent image is formed on the image carrier. The plurality of holders detachably hold a plurality of developing devices. The developing devices develop the latent image formed on the image carrier with toner of differing colors. The image carrier includes inspecting device capable of performing an inspection of whether or not the developing device is attached to the holder, and a nonvolatile rewritable storage region which stores detachment data for the developing device.

11 Claims, 14 Drawing Sheets

IMAGE-FORMING APPARATUS INCLUDING INSPECTION AND STORAGE OF DEVELOPING DEVICES

CROSS-REFERENCE TO RELATED APPLICATIONS

The present application claims priority upon Japanese Patent Application No. 2001-353684 filed Nov. 19, 2001, Japanese Patent Application No. 2001-353685 filed Nov. 19, 2001, and Japanese Patent Application No. 2001-374825 filed Dec. 7, 2001, which are herein incorporated by reference.

BACKGROUND OF THE INVENTION

1. Field of the Invention

The present invention relates to an image-forming apparatus such as a printer, photocopier, a facsimile machine, and the like, a storage medium, and a computer system.

2. Description of the Related Art

As one type of an image-forming apparatus, there is known an apparatus comprising a rotary-type developing unit, in which the rotary-type developing unit comprises a plurality of developing devices arranged radially about its axis of circular movement. The developing devices develop a latent image formed on a photoconductor using different-colored toner contained therein. When an image signal is transmitted from an external device such as a host computer, this image-forming apparatus sequentially changes the developing devices by rotating the rotating shaft, to thereby locate one of the plurality of developing devices in a developing position opposing the photoconductor. A toner image is formed by developing the latent image formed on the photoconductor, and the image is transferred to an intermediate medium. A color image is formed by superimposing the plurality of toner images, by sequentially changing the plurality of developing devices and repeating the developing and transferring in a similar manner.

Further, since each of the developing devices is attached in a respectively detachable manner, some developing devices comprise a detector which detects whether or not each of the developing devices is attached.

However, in an image-forming apparatus having a plurality of developing devices, the components must be relatively moved so as to sequentially move a certain developing device to a developing position opposing the photoconductor. Therefore, it is difficult to make it always possible to detect whether or not each of the developing devices is attached. For this reason, the above-mentioned detector is constructed so that it can detect whether or not each of the developing devices is attached, only when the respective developing devices and the image-forming apparatus body are arranged to be in a predetermined position.

Therefore, there is a problem in that, upon, for example, turning the power of the apparatus ON or exchanging a developing device, it is not possible to identify whether or not each of the developing devices is attached, and the presence/absence of attachment of each of the developing devices has to be confirmed by the above-mentioned detector.

Further, there are other types of an image-forming apparatus, other than the apparatus comprising the rotary-type developing unit that comprises a plurality of developing devices, which develop a latent image formed on a photoconductor using the different-colored toner contained therein, arranged radially about its axis of circular movement. There is known an apparatus comprising a slide-type developing unit 201, as shown in FIG. 14, in which the developing devices 200 are arranged in parallel. When an image signal is transmitted from an external device such as a host computer, these image-forming apparatuses locate one of the plurality of developing devices in a developing position opposing the photoconductor 20, by sequentially changing the developing devices through rotation of the rotating shaft in case of a rotary-type developing unit, and by sliding the developing devices 200, arranged in parallel, in case of a slide-type developing unit 201. A toner image is formed by developing the latent image formed on the photoconductor, and the image is transferred to an intermediate medium. A color image is formed by superimposing the plurality of toner images, by sequentially changing the plurality of developing devices and repeating the developing and transferring in a similar manner.

Developing devices corresponding to each of the above-mentioned colors are attached so that they can be respectively detached. However, the position of attachment to the developing unit is determined according to the color of the toner contained therein; and therefore, a developing device having the correct color must be attached to that attachment position. Therefore, a storage element storing therein information corresponding to each developing device, such as information relating to the color of the toner contained therein, is attached to each developing device; and, for example, upon turning the power of the apparatus ON or exchanging a developing device, confirmation is made by reading the data in the storage element using reading means provided on the body of the image-forming apparatus.

However, in such an image-forming apparatus, the components must be relatively moved so as to sequentially move a developing device having a certain color to a developing position opposing the photoconductor. Therefore, in a state where each of the developing devices and the image-forming apparatus are maintained connected, it is difficult to confirm, at all times, whether or not the developing devices being attached to the developing unit are the correct developing devices. Therefore, there is a problem in that, for example, upon exchanging of a developing device, even if another developing device having an inappropriate color is attached after a developing device has been detached, such a circumstance cannot be detected; and if printing is carried out in this state, a defective image with colors completely different from those of the image data will be output, thereby causing unwanted consumption of expendables such as ink, paper, and the like.

Further, some of the developing devices used in the above-mentioned image-forming apparatus comprise storage means capable of recording thereon various kinds of information, such as information relating to color of the toner contained in that developing device, consumption amount of the toner, and the like. The storage means is electrically connected with the body of the image-forming apparatus through mutual contact of the developing device and reading means provided on the body of the image-forming apparatus for reading the information from the developing device; and accordingly, the information is read. This information is used for various purposes.

No problem arises when power is being continuously supplied to the image-forming apparatus in a state where the above-mentioned developing device and the above-mentioned reading means are placed in contact. However, assume a case where, for example, in a state where the developing device and the reading means are in contact with each other, the power supply to the image-forming apparatus is stopped, such as when a user erroneously turns the image-forming apparatus OFF, and then the power supply to the image-forming apparatus is restarted, such as when the user turns the image-forming apparatus ON again. In such a case, because of interruption in power supply, the image-forming apparatus will not record, or remember, that the developing device and the reading means were in contact with each other; and therefore, the image-forming apparatus may carry out an operation to move the developing unit, that is for example, to move the developing unit to a later-explained home position. As a result, there arises a problem in that, since the developing devices attached to the developing unit will also move according to the movement of the developing unit, the contacting sections of the mutually-contacting developing device and the reading means may be damaged.

Further, there arises a problem that disorders will be caused in image-forming operations, for reasons such as that the movement of the developing device is interrupted, the movement of the developing unit towards its home position, which is to be a reference position of rotation of the developing unit, is interrupted, and the like.

SUMMARY OF THE INVENTION

The present invention has been contrived in view of the above and other problems, and an object thereof is to realize a highly-reliable image-forming apparatus.

Further, another object of the present invention is to realize an image-forming apparatus etc. in which it is possible to know whether or not all of the developing devices are attached on an occasion where, for example, the power of the apparatus is turned ON, without constantly connecting the apparatus body and each of the developing devices.

Further, another object of the present invention is to realize an image-forming apparatus etc. capable of preventing printing to be carried out while a developing device with a wrong color is attached, or while a developing device is detached.

Further, another object of the present invention is to realize an image-forming apparatus etc. that can effectively prevent damages of structural members.

Further, another object of the present invention is to realize an image-forming apparatus comprising an image carrier on which a latent image is formed; and a plurality of holders for detachably holding a plurality of developing devices, respectively, the developing devices developing the latent image formed on the image carrier with toner having colors that differ from each other.

Features of the present invention other than the above will become clear by the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein:

FIG. 7 is a flowchart showing operations in case all of the developing devices were attached when the power is turned ON;

FIG. 8 is a flowchart showing operations in case all of the developing devices were not attached when the power is turned ON;

DETAILED DESCRIPTION OF THE INVENTION

Figure 1:
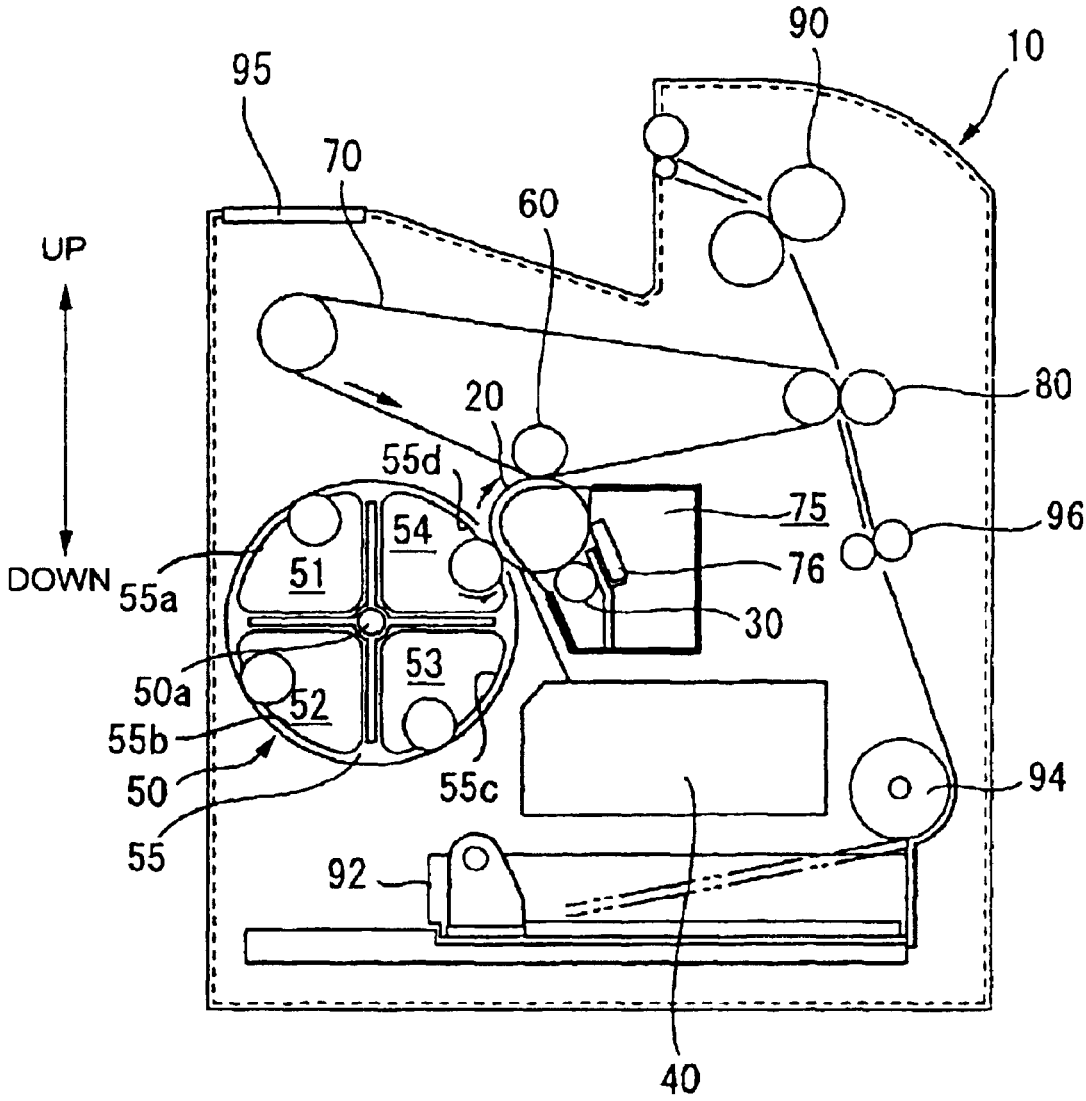
FIG. 1 is a diagram showing some main structural components constructing an image-forming apparatus according to an embodiment.

At least the following matters will be made clear by the explanation in the present specification and the description of the accompanying drawings.

An image-forming apparatus comprises: an image carrier on which a latent image is formed; and a plurality of holders for detachably holding a plurality of developing devices, respectively; the developing devices developing the latent image formed on the image carrier with toner having colors that differ from each other.

Preferably, in the above-mentioned image-forming apparatus: the image-forming apparatus further comprises inspecting means capable of performing an inspection of whether or not the developing device is attached to the holder when the inspecting means is arranged in a predetermined relative position in view of each of the holders, and a nonvolatile rewritable storage region in which detachment data indicating an occurrence of detachment of the developing device is stored when the developing device is detached from the holder; and if the detachment data is stored in the storage region when power of the image-forming apparatus is turned ON, the holder and the inspecting means are arranged in the relative position, and inspection is performed of whether or not the developing device is attached.

According to this image-forming apparatus, since the detachment data is stored in the nonvolatile storage region, i.e., a region that maintains the stored contents even when the power of the apparatus is shut-off when the developing device is detached from the holder, if there is no detachment data in the storage regions when the power is turned ON, it is possible to confirm that all of the developing devices are attached, and, if detachment data is stored in a storage region, it can be recognized that there is a possibility that a developing device has been detached. Further, if the detachment data is stored, it is possible to confirm whether or not the developing device is actually attached by inspecting the presence of that developing device with the inspecting means or inspector. Accordingly, it becomes possible to accurately confirm, for all developing devices, whether or not the developing device is attached.

In the above-mentioned image-forming apparatus, it may be configured so that, if the inspecting means determines that the developing device is attached, the detachment data is rewritten to attachment data indicating that the developing device is attached.

According to this image-forming apparatus, since the data is rewritten to attachment data if it is determined that the developing device is attached, it becomes possible to accurately grasp the state of attachment of the developing devices.

Further, in the above-mentioned image-forming apparatus: the image-forming apparatus may further comprise notifying means that generates a notification signal when an occurrence to be notified to a user takes place, and that makes a notice of this occurrence according to the notification signal; and if the inspecting means determines that the developing device is not attached, a notification signal for prompting attachment of the developing device may be generated.

According to this image-forming apparatus, it becomes possible to notify the user that a developing device is unattached.

Further, in the above-mentioned image-forming apparatus: black toner may be contained in one of the plurality of developing devices; the storage region may be provided for each of the colors of the toner contained in each of the developing devices held by corresponding ones of the holders; and if the detachment data is stored in a storage region that corresponds to a color other than black, an image-forming operation using the black toner may be made possible.

According to this image-forming apparatus, it becomes possible to carry out printing in black, for which particularly many printing request are made, even if a developing device having a color other than black has been detached.

Further, in the above-mentioned image-forming apparatus: the inspecting means may comprise accessing means capable of accessing a storage element provided on the developing device; and the inspection of whether or not the developing device is attached may be performed by determining whether or not the accessing means can access the storage element.

According to this image-forming apparatus, since the presence of a developing device is determined by whether a storage element provided on the developing device is accessible, the reliability of detection is higher than that of, for example, a light-reflection-type detector, and also, if data is stored on the storage element, it becomes possible to obtain that data.

Further, in the above-mentioned image-forming apparatus: a plurality of the storage regions may be provided corresponding to each of the holders; and if the detachment data is stored in any one of the storage regions when power of the image-forming apparatus is turned ON, inspection may be performed of whether or not the developing device is attached in respect to the holder corresponding to the storage region storing the detachment data.

According to this image-forming apparatus, according to the storage region storing the detachment data when the power is turned ON, it becomes possible to specify the holder which is deemed not holding a developing device. Therefore, there is no need to try to access all of the developing devices, but rather, it becomes possible to confirm attachment/detachment by trying to access only the developing device of the specified holder.

Further, in the above-mentioned image-forming apparatus: four of the holders may be provided at equiangular intervals about an axis of circular movement; and if the detachment data is stored in any one of the storage regions when power of the image-forming apparatus is turned ON, inspection may be performed of whether or not the developing device is attached in respect to the holder corresponding to the storage region storing the detachment data, and if it is determined that the developing device is not attached, detaching of a developing device that is attached to a holder adjacent to the holder, to which the developing device is not attached, may be forbidden.

According to this image-forming apparatus, it becomes possible to prevent a situation in which two adjacent developing devices out of four developing devices are detached. That is, it becomes possible to prevent an extremely unbalanced load from being imparted a rotational shaft, i.e., the axis of circular movement, reduce the amount of load imparted on a power source that drives the rotational shaft, and also compactize the power source. Therefore, it becomes possible to realize downsizing and cost reduction of the image-forming apparatus.

Further, in the above-mentioned image-forming apparatus: the developing device comprises a storage element storing toner-color information relating to a color of toner contained in the developing device; the image-forming apparatus comprises reading means that reads the color information from the storage element of a predetermined developing device when necessary, the reading means being capable of reading the information in the storage element when the reading means and the storage element of the developing device held in the holder are arranged in a predetermined relative position; and an image-forming operation is made possible if: the image-forming operation is forbidden before the developing device is detached from the holder; after a developing device has been attached to this holder, the reading means and the storage element of this developing device held in this holder are arranged in the relative position, and the color information of this developing device is read; and it is determined that a color specified by this color information matches the color of toner that is supposed to be contained in a developing device held in this holder.

According to this image-forming apparatus, since the image-forming operation is forbidden when a developing device is detached, in a case such as when a developing device is being exchanged, there is no fear that the image-forming operation will be carried out in a state where a developing device is detached. Further, since the image-forming operation is made possible only when the color information of the actually-attached developing device and the color information of a developing device that is supposed to be attached match each other, there is no possibility that an image-forming operation will be carried out with a developing device containing toner of the wrong color being attached, and also, it becomes possible to prevent expendables such as toner, paper, and the like from being consumed by printing a defective image.

Further, in the above-mentioned image-forming apparatus: the image-forming apparatus comprises a nonvolatile rewritable storage region storing state information indicating a state of the developing device, the state information being stored in correspondence with color-setting information indicating a color of toner that is supposed to be contained in a developing device held in each holder; according to a detachment-instructing signal instructing to detach a developing device specified by a color of toner contained therein, before this developing device is detached, the image-forming apparatus stores detachment data indicating an occurrence of detachment of this developing device in the storage region as the state information; the detachment data being stored in correspondence with the color information of the color having been specified; according to an attachment signal indicating that a developing device has been attached to this holder, the image-forming apparatus arranges the storage element of this developing device and the reading device in the relative position and reads the color information in the storage element; and if it is determined that this color information matches the color-setting information of this holder, the image-forming operation is made possible by rewriting the state information to attachment data indicating that the developing device has been attached. Here, the nonvolatile storage region means a storage region in which contents of storage is maintained even when power of the apparatus is shut off.

According to this image-forming apparatus, the detachment data will be stored in the storage region of the apparatus body from when a developing device is detached to when a proper developing device is attached. Therefore, there will be no need to read the information in the storage element of each developing device, and it will be possible to grasp the state of attachment of each of the developing devices. For example, assume a case in which the power is shut off in a state where a developing device is still detached for exchange, and the power is turned ON again in this state. Even in such a case, according to the state information stored in the nonvolatile storage region, it becomes possible to grasp the state of attachment of the developing devices and prevent image-forming operations in a state where a developing device is detached. Further, there is no need to read the information in the storage element of each developing device at the time of, for example, turning the power of the apparatus ON; therefore, time for moving the developing device, time for reading the information, and the like can be shortened, and it will become possible to realize a printable state in a short time.

Further, in the above-mentioned image-forming apparatus: each of the developing devices may be attachable to any one of the holders.

According to this image-forming apparatus, it becomes possible to attach each of the developing devices to any of the holders by changing the toner contained, and it becomes possible to realize an inexpensive developing device by sharing structural parts other than the toner.

Further, in the above-mentioned image-forming apparatus: if the detachment data is stored in the storage region as the state data when power of the image-forming apparatus is turned ON, the reading means and the storage element of a corresponding developing device may be arranged in the relative position.

According to this image-forming apparatus, if there is a possibility that any one of the developing devices is detached at the time the power is turned ON, it becomes possible to read information in the storage element of that developing device.

Further, in the above-mentioned image-forming apparatus: the color information may be read from the storage element of the developing device having been arranged in the relative position, and if it is determined that this color information and the color-setting information match, the state information may be rewritten to the attachment data.

According to this image-forming apparatus, even if image forming is forbade at the time the power is turned ON, it becomes possible to carry out image forming instantly if the developing device attached to the relevant holder is suitable.

Further, in the above-mentioned image-forming apparatus: black toner may be contained in one of the plurality of developing devices; and if there is a request to form an image using the black toner in a case where the detachment data is stored in the storage region that corresponds to a color other than black, the detachment data may be rewritten to the attachment data, and an image-forming operation using the black toner may be made possible.

According to this image-forming apparatus, it becomes possible to carry out printing using black toner, for which particularly many image-forming request are made, even if a developing device having a color other than black has been detached.

Further, in the above-mentioned image-forming apparatus: the image-forming apparatus may comprise notifying means that generates a notification signal when an occurrence to be notified to a user takes place, and that makes a notice of the occurrence according to the notification signal; and if there is an occurrence where it is determined that a color specified by the color information having been read from the storage element is different from the color of toner that is supposed to be contained in a developing device held in the holder, the notifying means may generate a notification signal for notifying this occurrence.

According to this image-forming apparatus, since the user is notified that a developing device containing toner having a color that is not supposed to be contained, it becomes possible to prevent printing of a defective image using toner of the wrong color.

Further, in the above-mentioned image-forming apparatus: the image-forming apparatus may comprise notifying means that generates a notification signal when an occurrence to be notified to a user takes place, and that makes a notice of this occurrence according to the notification signal; and if there is an occurrence where the storage element of the developing device that is supposed to be held in a predetermined one of the holders cannot be accessed, the notifying means may generate a notification signal for notifying this occurrence.

According to this image-forming apparatus, it becomes possible to notify the user that a developing device is not attached.

Further, preferably, in the above-mentioned image-forming apparatus: the developing device comprises storage means capable of storing various kinds of information; the image-forming apparatus comprises: a movable moving element having the holders, and reading means for reading the information from the developing device attached to the holder; the information can be read by placing the reading means and the developing device in contact with each other; and when power is supplied to the image-forming apparatus, the reading means and the developing device are separated from each other.

By separating the reading means and the developing device from each other when power is supplied to the image-forming apparatus, it becomes possible to effectively prevent damages on the connecting sections of the reading means and the developing device. Further, it is possible to effectively prevent a problem in that disorders will be caused in image-forming operations, for reasons such as that the movement of the developing unit is interrupted, the movement of the developing unit towards its home position, which is to be a reference position of rotation of the developing unit, is interrupted, and the like.

Further, information indicating that the reading means and the developing device are in contact with each other can be stored in storing means that can keep information stored even when power supply to the image-forming apparatus is stopped; and if this information is stored when power is supplied to the image-forming apparatus, the reading means and the developing device may be separated from each other.

Accordingly, the image-forming apparatus will try to make both connectors separate from each other only if it is necessary to separate the reading means and the developing device from each other. Therefore, it becomes possible to reduce the frequency of operating the motor for separating the connectors, and to effectively reduce the noise caused by operation of the motor.

Further, the information indicating that the reading means and the developing device are in contact with each other may be stored when an instruction for making the reading means and the developing device contact each other is issued.

Accordingly, for example, there will be no need to provide a sensor for detecting that the reading means and the developing device are in contact with or separated from each other, and it will be possible to achieve reduction in costs of the image-forming apparatus.

Further, a plurality of the holders may be provided on the moving element; and the reading means and the developing device may be separated from each other to a position where the reading means does not interfere with the moving element and does not interfere with any one of the plurality of developing devices attached to the moving element when the moving element moves.

Accordingly, it becomes possible to effectively prevent damages of not only the contacting sections of the reading means and the developing device, but also other members of the image-forming apparatus.

Further, the reading means and the developing device may be first separated from each other when power is supplied to the image-forming apparatus; and the moving element may be moved to a predetermined initial position.

Accordingly, since the predetermined initial position can be taken as a reference position for determining a position for the moving element to carry out a process after movement to the initial position, it is possible to easily realize an image-forming apparatus achieving an effect of being able to effectively prevent damages on the contacting section of the reading means and the developing device.

Further, the reading means and the developing device may be placed in contact with and separated from each other by moving the reading means.

Accordingly, there is a merit in that it becomes possible to simplify the mechanism of the developing device, which tends to be produced in larger quantities compared to the body of the image-forming apparatus.

Further, computer-readable storage medium has a program recorded thereon. The program makes an image-forming apparatus operate. The image-forming apparatus comprises: an image carrier on which a latent image is formed; and a plurality of holders for detachably holding a plurality of developing devices, respectively; the developing devices developing the latent image formed on the image carrier with toner having colors that differ from each other.

Further, computer system comprises: a computer; and an image-forming apparatus that can be connected to the computer. The image-forming apparatus comprises: an image carrier on which a latent image is formed; and a plurality of holders for detachably holding a plurality of developing devices, respectively; the developing devices developing the latent image formed on the image carrier with toner having colors that differ from each other.

Outline of Image-Forming Apparatus (Laser-beam Printer)

Next, with reference to FIG. 1, explanation will be made of a general outline of a laser-beam printer 10 (hereinafter referred to as "printer"), as an example of an image-forming apparatus. FIG. 1 is a diagram showing some main structural components constructing the printer 10. In FIG. 1, the vertical direction is shown by the arrow; for example, a paper-feed tray 92 is arranged at a lower section of the printer 10, and a fusing unit 90 is arranged at an upper section of the printer 10.

As shown in FIG. 1, the printer 10 according to the present embodiment comprises the following components along the rotating direction of a photoconductor 20 which is a latent-image carrier carrying a latent image: a charging unit 30; an exposing unit 40; a YMCK developing unit 50; a first transferring unit 60; an intermediate transferring element 70; and a cleaning head 75. The printer 10 further comprises: a second transferring unit 80; a fusing unit 90; a displaying unit 95 comprising a liquid-crystal display and serving as notifying means to a user; and a controlling unit (FIG. 2) controlling the above-mentioned units and managing the operations as a printer.

The photoconductor 20 comprises a cylindrical, conductive base and a photoconductive layer formed on its outer peripheral surface, and is rotatable about a central axis. In the present embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by radiation of laser. The exposing unit 40 comprises, for example, a semiconductor laser, a polygon mirror, an F-θ lens, and the like, and radiates onto the charged photoconductor 20 with modulated laser according to the image signal having been input from the not-shown host device such as a personal computer, a word processor, and the like.

The YMCK developing unit 50 is a device for developing the latent image formed on the photoconductor 20 using yellow (Y) toner, magenta (M) toner, cyan (C) toner, and black (K) toner.

The YMCK developing unit 50 comprises four holders, or holding sections, 55*a*, 55*b*, 55*c*, 55*d* that can respectively hold a black developing device 51 containing black (K) toner, a magenta developing device 52 containing magenta (M) toner, a cyan developing device 53 containing cyan (C) toner, and a yellow developing device 54 containing yellow (Y) toner. The four developing devices 51, 52, 53, 54 are constructed to be rotatable about a rotating shaft 50*a*, which is an axis of circular movement, by a stepper motor connected to the rotating shaft 50*a*. The developing devices selectively oppose the photoconductor 20 every time the photoconductor 20 rotates once, and the latent image formed on the photoconductor 20 is developed by the toner contained respectively in the developing devices 51, 52, 53, 54. Details on each of the developing devices will be explained later.

The first transferring unit 60 is a device for transferring a single-color toner image formed on the photoconductor 20 onto the intermediate transferring element 70. When the toners of all four colors are sequentially transferred in a superimposing manner, a full-color toner image will be formed on the intermediate transferring element 70. The intermediate transferring element 70 is an endless belt, and is rotatingly driven at the same circumferential speed as the photoconductor 20. The second transferring unit 80 is a device for transferring the single-color toner image or the full-color toner image formed on the intermediate transferring element 70 onto a recording medium, such as paper, film, cloth, and the like.

The fusing unit 90 is a device for fusing, to the medium such as paper, the single-color toner image or the full-color toner image which has been transferred onto the recording medium, to make it into a permanent image.

The cleaning unit 75 is a device which is provided between the first transferring unit 60 and the charging unit 30, has a rubber cleaning blade 76 placed in contact with the surface of the photoconductor 20, and removes the toner remaining on the photoconductor 20 by scraping-off with the cleaning blade 76 after the toner image has been transferred onto the intermediate transferring element 70 by the first transferring unit 60.

Figure 2:
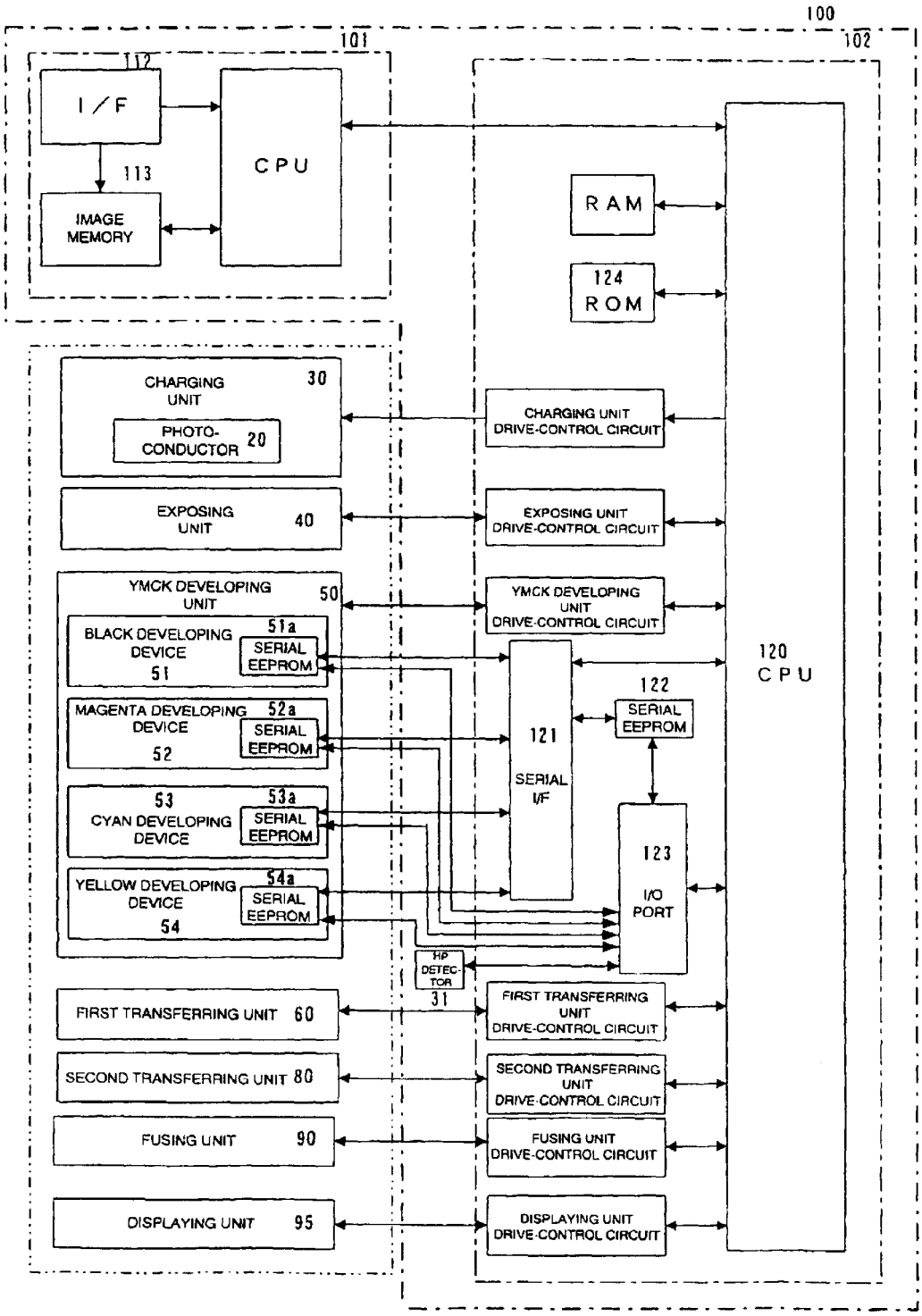
FIG. 2 is a block diagram showing a controlling unit of the image-forming apparatus of FIG. 1.

The controlling unit 100 comprises a main controller 101 and a unit controller 102 as shown in FIG. 2. An image signal is input to the main controller 101; and according to instructions based on the image signal, the unit controller 102 controls each of the above-mentioned units to form an image.

Next, explanation will be made of operations of the printer 10 structured as above, with reference to other structural components.

First, when an image signal is input from the not-shown host device to the main controller 101 of the printer 10 through an interface (I/F) 112, the photoconductor 20, a developing roller provided on the developing device as a toner carrier, and the intermediate transferring element 70 rotate under the control of the unit controller 102 based on the instructions from the main controller 101. While rotating, the photoconductor 20 is sequentially charged by the charging unit 30 at a charging position.

With the rotation of the photoconductor 20, the charged area of the photoconductor 20 reaches an exposure position. A latent image in accordance with image information relating to the first color, such as yellow Y, is formed in the charged area by the exposing unit 40. The YMCK developing unit 50 locates the yellow developing device 54 containing yellow (Y) toner in a developing position opposing the photoconductor 20.

With the rotation of the photoconductor 20, the latent image formed on the photoconductor 20 reaches the developing position, and is developed with the yellow toner by the yellow developing device 54. Accordingly, a yellow toner image is formed on the photoconductor 20.

With the rotation of the photoconductor 20, the yellow toner image formed on the photoconductor 20 reaches a first transferring position, and is transferred onto the intermediate transferring element 70 by the first transferring device 60.

Here, a first transferring voltage, having an opposite polarity from the charge polarity of the toner, is applied to the first transferring unit 60. During the above, the second transferring unit 80 is kept apart from the intermediate transferring element 70.

By repeating the above-mentioned process for the second, the third, and the fourth colors, toner images in four colors corresponding to the respective image signals are transferred to the intermediate transferring element 70 in a superimposed manner. Accordingly, a full-color toner image is formed on the intermediate transferring element 70.

With the circular movement of the intermediate transferring element 70, the full-color toner image formed on the intermediate transferring element 70 reaches a second transferring position, and is transferred onto a recording medium by the second transferring unit 80. The recording medium is carried from the paper-feed tray 92 to the second transferring unit 80 through the paper-feed roller 94 and resisting rollers 96. Upon transferring operation, a second transferring voltage is applied to the second transferring unit 80 as the unit 80 is pressed against the intermediate transferring element 70.

The full-color toner image transferred onto the recording medium is heated and pressurized by the fusing unit 90 and fused to the recording medium.

On the other hand, after the photoconductor 20 passes the first transferring position, the toner attaching to the surface of the photoconductor 20 is scraped-off by the cleaning blade 76 that is supported to the cleaning unit 75, and the photoconductor 20 is prepared for charging for forming a next latent image. The scraped-off toner is collected in a remaining-toner collector that the cleaning unit 75 comprises.

The photoconductor 20 is made into a unit with the charging unit 30 and the cleaning unit 75, and is attachable/detachable to/from the body of the printer 10. Further, the black developing device 51, the magenta developing device 52, the cyan developing device 53, and the yellow developing device 54 are respectively attachable/detachable to/from the body of the printer 10, and are formed so that they are attachable to any one of the holders 55*a*, 55*b*, 55*c*, 55*d* provided on the YMCK developing unit 50.

Outline of Developing Device

Figure 3:
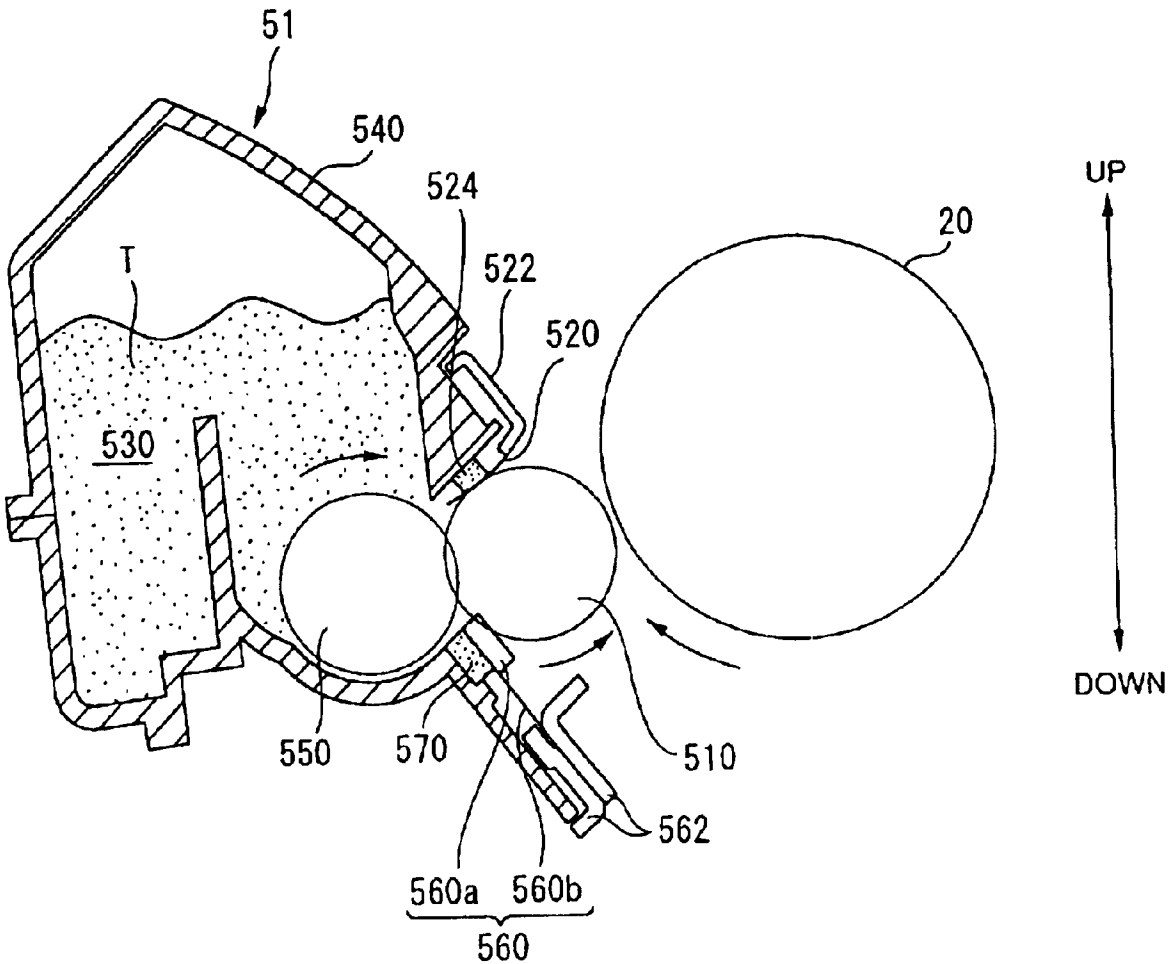
FIG. 3 is a sectional diagram showing some main structural components of a developing device.

Next, with reference to FIG. 3, explanation will be made of a general outline of the developing device. FIG. 3 is a sectional diagram showing some main structural components of the developing device. Alike FIG. 1, in FIG. 3, the arrow indicates the vertical directions; for example, the central axis of the developing roller 510 is located below the central axis of the photoconductor 20. Further, FIG. 1 shows a state in which the yellow developing device 54 is located in the developing position opposing the photoconductor 20.

The YMCK developing unit 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made only of the yellow developing device 54.

The yellow developing device 54 comprises: the developing roller 510 as a developing-agent carrier; a sealing member 520; a toner reservoir 530; a frame 540; a toner-supplying roller 550 as a toner-supplying member; a restriction blade 560 as a thickness-restricting member; and a blade-backing member 570 for urging the restriction blade 560.

The developing roller 510, as the toner carrier, carries toner T and delivers it to a developing position opposing the photoconductor 20. The developing roller 510 is made from, for example, aluminum, stainless steel, iron, and the like, and when necessary, the roller 510 is plated with, for example, nickel plating, chromium plating, and the like. Further, the developing roller 510 is rotatable about a central axis. As shown in FIG. 3, the roller 510 rotates in the opposite direction (counterclockwise in FIG. 3) from the rotating direction of the photoconductor 20 (clockwise in FIG. 3). The central axis of the roller 510 is located below the central axis of the photoconductor 20. As shown in FIG. 3, in the state where the yellow developing device 54 opposes the photoconductor 20, there exists a gap between the developing roller 510 and the photoconductor 20. That is, the yellow developing device 54 develops the latent image formed on the photoconductor 20 in a non-contacting state. Note that an alternating field is generated between the developing roller 510 and the photoconductor 20 upon developing the latent image formed on the photoconductor 20.

The sealing member 520 prevents the toner T in the yellow developing device 54 from escaping out therefrom, and also collects the toner T, which is on the developing roller 510 that has passed the developing position, into the developing device without scraping it off. The sealing member 520 is a seal made from, for example, polyethylene film and the like. The sealing member 520 is supported by a seal-supporting metal plate 522, and is attached to the frame 540 through the seal-supporting metal plate 522. On the opposite side of the side of the developing roller 510, the sealing member 520 is provided with a seal-urging member 524 made from, for example, Moltoprene and the like. The sealing member 520 is pressed to the developing roller 510 by the elastic force of the seal-urging member 524. Note that a contacting position at which the sealing member 520 contacts the developing roller 510 is above the central axis of the developing roller 510.

The toner reservoir 530 is a section for receiving the toner T; and a portion of the frame 540 structures the reservoir 530. A stirring member for stirring the toner T contained in the toner reservoir 530 may be provided. However, in the present embodiment, each of the developing devices (the black developing device 51, the magenta developing device 52, the cyan developing device 53, and the yellow developing device 54) rotate with the rotation of the YMCK developing unit 50, and the toner T contained within each developing device is stirred therewith; therefore, the toner reservoir 530 does not comprise a stirring member.

The toner-supplying roller 550 supplies the toner T contained in the toner reservoir 530 to the developing roller 510. The toner-supplying roller 550 is made from, for example, polyurethane foam and the like, and is in contact with the developing roller 510 in an elastically-deformed state. The toner-supplying roller 550 is arranged at a lower section of the toner reservoir 530. The toner T contained in the toner reservoir 530 is supplied to the developing roller 510 by the toner-supplying roller 550 at the lower section of the toner reservoir 530. The toner-supplying roller 550 is rotatable about a central axis. The central axis is situated below the central axis of rotation of the developing roller 510. Further, the toner-supplying roller 550 rotates in the opposite direction (clockwise in FIG. 3) from the rotating direction of the developing roller 510 (counterclockwise in FIG. 3). Note that the toner-supplying roller 550 has a function of supplying the toner T contained in the toner reservoir 530 to the developing roller 510, as well as the function of stripping-off, from the developing roller 510, the toner remaining on the developing roller 510 after development.

The restriction blade 560, as a thickness-restricting member, restricts the thickness of the layer of the toner T carried by the developing roller 510, and also gives charge to the toner T carried by the developing roller 510. The restriction blade 560 comprises a rubber portion 560*a* and a rubber-supporting portion 560*b*. The rubber portion 560*a* is made from, for example, silicone rubber, urethane rubber, and the like. The rubber-supporting portion 560*b* is a thin plate made from, for example, phosphor bronze, stainless steel, and the like having a springy characteristic. The rubber portion 560*a* is supported by the rubber-supporting portion 560*b*. The rubber-supporting portion 560*b* is attached to the frame 540 through a pair of blade-supporting metal plates 562, in a state where one end of the rubber-supporting portion 560*b* is pinched between the blade-supporting-metal plates 562. On the opposite side from the side of the developing roller 510, the restriction blade 560 is provided with a blade-backing member 570 made from, for example, Moltoprene, and the like.

The rubber portion 560*a* is pushed against the developing roller 510 by the elastic force caused by bending of the rubber-supporting portion 560*b*. Further, the blade-backing member 570 prevents toner from entering between the rubber-supporting portion 560*b* and the frame 540 so as to stabilize the elastic force caused by bending of the rubber-supporting portion 560*b*, and urges the rubber portion 560*a* from the back of the rubber portion 560*a* towards the developing roller 510 to press the rubber portion 560*a* against the developing roller 510. Therefore, the blade-backing member 570 can make the rubber portion 560*a* contact the developing roller 510 more evenly.

The other end of the restricting blade 560 that is not being supported by the blade-supporting metal plates 562, i.e., the tip end of the restriction blade 560 does not contact the developing roller 510; but a section at a predetermined distance from the tip end contacts, with some breadth, the developing roller 510. That is, the restriction blade 560 does not contact the developing roller 510 with its end, but contacts the roller 510 near its central portion. Further, the restriction blade 560 is arranged so that its tip end faces towards the upper stream of the rotating direction of the developing roller 510, and thus, makes a so-called counter-contact. Note that a contacting position at which the restriction blade 560 contacts the developing roller 510 is below the central axis of the developing roller 510, and also below the central axis of the toner-supplying roller 550.

The frame 540 is manufactured by joining a plurality of integrally-molded frames (for example, an upper frame, a bottom frame, and the like). The frame 540 has an opening at its lower section. The developing roller 510 is arranged at the opening in a state so that a portion of the roller 510 is exposed.

In the yellow developing device 54 thus structured, the toner-supplying roller 550 supplies the toner T contained in the toner reservoir 530 to the developing roller 510. Having been supplied to the developing roller 510, with the rotation of the developing roller 510, the toner T reaches the contacting position of the restriction blade 560; and, as the toner T passes the contacting position, its thickness is restricted and the toner T is charged. Having its thickness being restricted, with further rotation of the developing roller 510, the toner T on the developing roller 510 reaches the developing position opposing the photoconductor 20; and under the alternating field, the toner T is provided for developing the latent image formed on the photoconductor 20 at the developing position. Having passed the developing position with further rotation of the developing roller 510, the toner T on the developing roller 510 passes the sealing member 520 and is collected into the developing device by the sealing member 520 without being scraped off.

Further, each of the developing devices 51, 52, 53, 54 respectively comprise nonvolatile storage memories (hereinafter referred to as "developing-device memory"; as an example of storage means, a storage element, or a storer) 51*a*, 52*a*, 53*a*, 54*a*, such as a serial EEPROM and the like, recording thereon, as data, information relating to the color of the toner contained in the developing device, and information relating to the developing device such as, for example, a consumption amount of toner.

Each of the developing-device memories 51*a*, 52*a*, 53*a*, 54*a* are electrically connected, respectively, to the unit controller 102 of the body-controlling unit 100 by establishing, when necessary, a contact between connectors 51*b*, 52*b*, 53*b*, 54*b*, which are respectively provided on the side surface of one end of each of the developing devices, and a common connector 34, which is provided on the apparatus body (i.e., on the printer). The connectors 51*b*, 52*b*, 53*b*, 54*b* are an example of means for sending-out the above-mentioned information, and are connected to the respective developing-device memories. The common connector 34 is an example of reading means, or a reader, for reading the above-mentioned information from the connectors 51*b*, 52*b*, 53*b*, 54*b*.

Further, the connectors 51*b*, 52*b*, 53*b*, 54*b* of the developing devices and the common connector 34 (which may also serve as accessing means) form inspecting means, or inspectors, for inspecting whether or not a developing device is attached. This is done by the connectors 51*b*, 52*b*, 53*b*, 54*b* and the common connector 34 being fitted together, the developing-device memories and the unit controller 102 being electrically connected to each other, and the unit controller 102 accessing the developing-device memories 51*a*, 52*a*, 53*a*, 54*a*.

Outline of YMCK Developing Unit and Its Relative Position in View of Device Body Next, with reference to FIG. 1, FIG. 4A, FIG. 4B, and FIG. 4C, explanation will be made of a general overview of a YMCK developing unit 50, to which the developing devices are attachable/detachable, as one example of a movable moving element.

The YMCK developing unit 50 comprises a rotating shaft 50*a*, as an axis of circular movement, positioned at the center thereof. A supporting frame 55 for holding the developing devices is fixed to the rotating shaft 50*a*. The rotating shaft 50*a* is spanned between two, side-frame plates (not shown) which make up a housing of the printer 10, and both ends of the shaft are supported.

Four holders 55*a*, 55*b*, 55*c*, 55*d*, by which the above-mentioned developing devices 51, 52, 53, 54 of four colors are detachably held about the rotating shaft 50*a*, are arranged in the supporting frame 55 at 90° intervals in the circumferential direction.

A not-shown stepper motor is connected to the rotating shaft 50*a* through a clutch. By activating the stepper motor, it is possible to make the supporting frame 55 rotate, and to locate the four developing devices 51, 52, 53, 54 in predetermined positions.

Figure 4A:
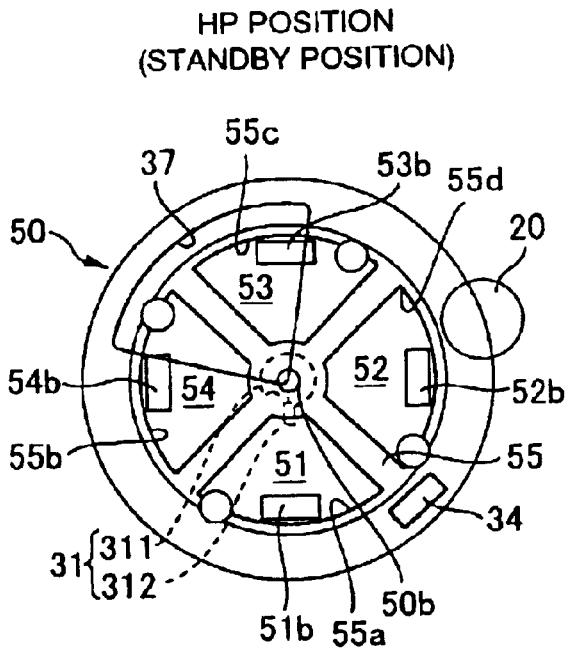
FIG. 4A is a diagram showing a home position of the developing device.
Figure 4B:
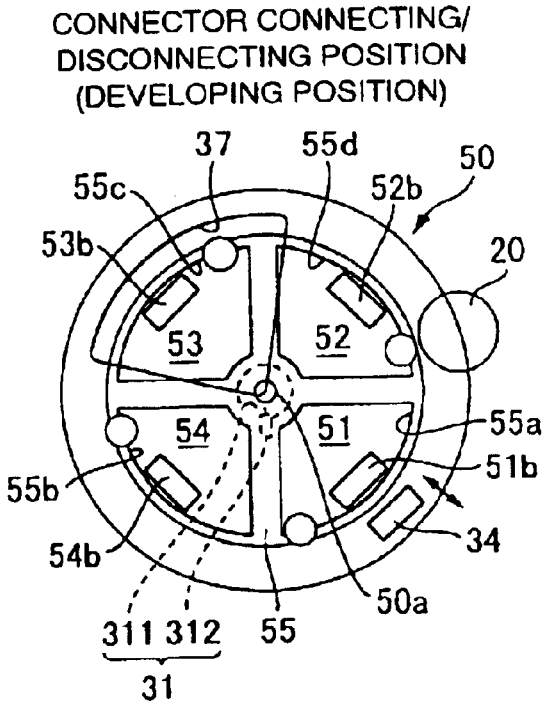
FIG. 4B is a diagram showing a connector connecting/disconnecting position where a memory (and a connector) of a black developing device and a common connector 34 of the image-forming apparatus body oppose.
Figure 4C:
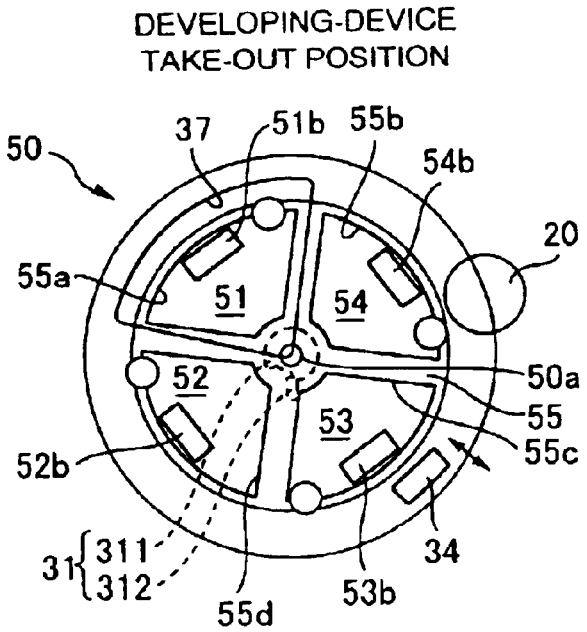
FIG. 4C is a diagram showing a take-out position (attaching/detaching position) of the black developing device.

FIG. 4A through FIG. 4C are diagrams showing three stopping positions of the rotating YMCK developing unit 50: FIG. 4A shows a home position (hereinafter referred to as "HP position"), as a predetermined initial position, which is to be a reference position in the rotating direction of the YMCK developing unit 50; FIG. 4B shows a connector connecting/disconnecting position in which the memory (and the connector) of the black developing device and the common connector 34 of the printer body oppose each other; and FIG. 4C shows a take-out position (attaching/detaching position) of the black developing device. In FIG. 4B and FIG. 4C, the connector connecting/disconnecting position and the developing device take-out position are shown in view of the black developing device 51. However, when the YMCK developing unit 50 is rotated at 90° intervals, FIG. 4B will be indicating the connector connecting/disconnecting position for another developing device, and FIG. 4C will be indicating the developing device take-out position for another developing device, sequentially. When a developing device to be connected by (or, in other words, which is the connecting object of) the common connector 34 of the printer body is located at the connector connecting/disconnecting position, the developing device adjacent to this developing device on the downstream-side in the rotating direction upon image-forming operations (counterclockwise in FIG. 4) is arranged at the developing position opposing the photoconductor 20.

As shown in FIG. 4A, on one end of the rotating shaft 50*a* of the YMCK developing unit 50, there is provided an HP detector 31 for detecting the HP position. The HP detector 31 is composed of: a signal-generating disk 311 fixed to one end of the rotating shaft 50*a*; and an HP sensor 312 comprising, for example, a photointerrupter having a light receptor and a light emitter. The peripheral edge of the disk 311 is arranged so that it is located between the light emitter and the light receptor of the HP sensor 312. When a slit formed in the disk 311 moves to a detecting position of the HP sensor 312, the output signal of the HP sensor 312 changes from "L" to "H". The HP position of the YMCK developing unit 50 is detected based on this change in signal level; and the device is so constructed so that, by taking this HP position as a reference, each of the developing devices can be located at the connector connecting/disconnecting position (the developing position) and the developing device take-out position by rotating the stepper motor by a predetermined number of pulses.

FIG. 4B shows the connector connecting/disconnecting position of the black developing device 50 when the stepper motor is rotated from the above-mentioned HP position by a predetermined number of pulses. At this connector connecting/disconnecting position, the holder 55*a*, which is provided on the black developing device 51 attached to the YMCK developing unit 50, and the common connector 34, which is to be a connecting point of the above-mentioned inspecting means, are arranged at a predetermined position; accordingly, the above-mentioned connector 51*b* and the common connector 34 provided on the printer body oppose each other, and a positional relationship is established so that both of the connectors can be fitted together.

Figure 5A:
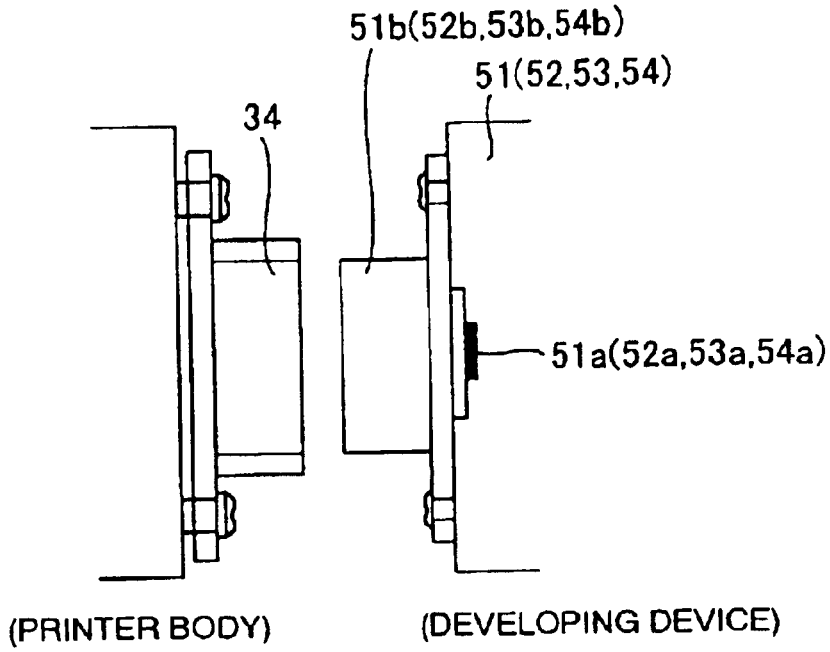
FIG. 5A is a diagram showing a state in which a common connector 34 and a connector 51*b* provided on the black developing device 51 are separated from each other.
Figure 5B:
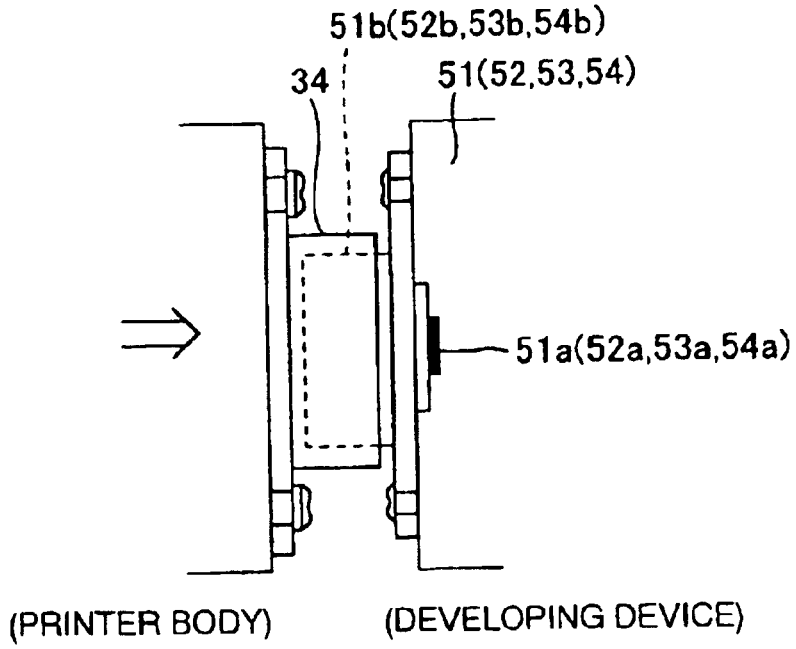
FIG. 5B is a diagram showing a state in which the common connector 34 and the connector 51*b* provided on the black developing device 51 are in contact with each other.

Since the common connector 34 is fitted to the connector 51*b* of the black developing device 51, the common connector 34 is structured to be able to move towards and apart from the YMCK developing unit 50, as shown in FIG. 5A and FIG. 5B; and, when necessary, the connector 34 moves towards the developing device and fits with the connector 51 of the black developing device 51. Accordingly, the developing-device memory 51*a* attached to the black developing device 51 is electrically connected to the unit controller 102 of the controlling unit 100, and data is transferred therebetween.

Further explanation will be made using FIG. 5A and FIG. 5B.

FIG. 5A and FIG. 5B are diagrams showing the separated position and the contacting position of the connector 51*b* of the black developing device 51 and the common connector 34 provided on the printer body.

FIG. 5A shows a state in which the common connector 34 provided on the printer body and the connector 51*b* provided on the black developing device 51 are separated from each other. The common connector 34 is structured to be able to move towards and apart from the black developing device 51, and, when necessary, it moves towards the black developing device 51 (refer to the arrow shown in FIG. 5B).

Accordingly, as shown in FIG. 5B, the common connector 34 contacts the connector 51*b* of the black developing device 51, and the developing-device memory 51*a* attached to the black developing device 51 is electrically connected to the unit controller 102 of the controlling unit 100, and data is transferred therebetween.

On the contrary, from the state in which the common connector 34 and the connector 51*b* of the black developing device 51 are connected as shown in FIG. 5B, the common connector 34 moves away from the black developing device 51 (refer to the arrow shown in FIG. 5B). Accordingly, as shown in FIG. 5A, the common connector 34 is separated from the connector 51*b* of the black developing device 51.

Note that the above-mentioned movement of the common connector 34 is realized by a not-shown mechanism which is configured by: the stepper motor, a plurality of gears connected to the stepper motor, and an eccentric cam connected to the gears.

That is, when the stepper motor is rotated by a predetermined number of pulses, the above-mentioned mechanism makes the common connector 34 move a certain distance, that corresponds to the above-mentioned number of pulses, from a predetermined separated position and locates the common connecter 34 in a predetermined contacting position.

On the contrary, when the stepper motor is reversingly-rotated by a predetermined number of pulses, the above-mentioned mechanism makes the common connector 34 move a certain distance, that corresponds to the above-mentioned number of pulses, from a predetermined contacting position and locates the common connecter 34 in a predetermined separated position.

In the present embodiment, there is no means, such as sensors, for detecting whether the connector 51*b* of the black developing device 51 and the common connector 34 are in contact with or separated from each other; but instead, it is assumed that both of the connectors are in contact with or separated from each other by the rotation (and reverse rotation) of the stepper motor rotating according to the predetermined number of pulses.

The connector connecting/disconnecting position for the black developing device 51 becomes the developing position for the magenta developing device 52 in which the developing roller 510 of the magenta developing device 52 and the photoconductor oppose each other. Further, when the YMCK developing unit 50 is rotated counterclockwise by 90° by the stepper motor, there will be realized the connector connecting/disconnecting position for the yellow developing device 54 and the developing position for the black developing device 51; and every time the YMCK developing unit 50 is rotated by 90°, the connector connecting/disconnecting position and the developing position for each of the developing devices will subsequently be realized.

A take-out dedicated opening (an opening dedicated for attaching/detaching) 37 is provided in one of the two side-frame plates which form the housing of the printer 10 and which support the YMCK developing unit 50. One developing device can pass through this opening 37. The take-out dedicated opening 37 is formed in a position where, when the YMCK developing unit 50 is rotated and stopped at a developing-device take-out position, which is set for each developing device, only that developing device (in this case, the black developing device 51) can be pulled out in a direction parallel to the rotating shaft 50*a*, as shown in FIG. 4C. The take-out dedicated opening 37 is formed slightly larger than the outer dimension of the developing device. At the developing-device-take-out position, it is possible to make a new developing device enter through the take-out dedicated opening 37 in the direction parallel to the rotating shaft 50*a*, and attach the developing device to the supporting frame 55. If the developing device is located at a position other than the developing-device take-out position, taking-out or detachment of that developing device will be restricted by the side-frame plate.

Note that there is provided a not-shown locking mechanism for securely locating and fixing the YMCK developing unit 50 in the above-mentioned developing position, the developing-device take-out position, and the connector connecting/disconnecting position.

Outline of Controlling Unit

Next, with reference to FIG. 2, explanation will be made of the configuration of the controlling unit 100. The main controller 101 of the controlling unit 100 is connected to the host device through an interface (I/F) 112 and comprises an image memory 113 for storing image signals input from the host device. The unit controller 102 is electrically connected to each of the units of the printer apparatus (i.e., the charging unit 30, the exposing unit 40, the YMCK developing unit 50, the first transferring unit 60, the cleaning unit 75, the second transferring unit 80, the fusing unit 90, and the displaying unit 95). By receiving signals from sensors provided on each of the units, the unit controller 102 detects the state of each unit and controls each unit according to the signals input from the main controller 101.

Further, the unit controller 102 has a CPU 120. The CPU 120 is connected to a nonvolatile storing element (hereinafter referred to as "printer-body memory") 122 for use as an electronic counter, such as a serial EEPROM, through a serial interface (I/F) 121. The printer-body memory 122 can keep the information stored even when power supply to the printer 10 is stopped. Data necessary for apparatus control is stored in the printer-body memory 122. Further, not only the printer-body memory 122, but also, the developing-device memories 51*a*, 52*a*, 53*a*, 54*a* provided respectively on the developing devices 51, 52, 53, 54 are connected to the CPU 120 through the serial interface 121. Accordingly, it becomes possible to transfer data between the printer-body memory 122 and the developing-device memories 51*a*, 52*a*, 53*a*, 54*a*, and also, it becomes possible to input chip-select signals CS to the respective developing-device memories 51*a*, 52*a*, 53*a*, 54*a* through an input/output port 123. Therefore, after a predetermined developing device is moved to the connector connecting/disconnecting position and the connector of this developing device and the common connector 34 of the printer body are connected, it becomes possible to read data from a memory designated by the chip-select signal CS. Further, the CPU 120 is connected to the HP detector 31 through the input/output port 123.

Four storage regions, for storing a state regarding attachment of the developing devices and expressed as 1-bit "0" or "1" data, are established on the printer-body memory 122 of the unit controller 102. "1" is data (detachment data) indicating an occurrence of detachment of a relevant developing device; whereas "0" is data (attachment data) indicating that a proper developing device is attached.

The storage region is provided for each developing device, and is made to correspond to attachment-position information, relating to the position of attachment of the developing device, and toner-color-information, relating to the color of toner contained in the developing device. For example, a first storage region stores data indicating the state regarding attachment of the black developing device 51; a second storage region stores that of the magenta developing device 52; a third storage region stores that of the cyan developing device 53; and a fourth storage region stores that of the yellow developing device 54. If all of the proper developing devices are attached, "0" will be stored in all of the storage regions. When a user, for example, inputs an instruction signal indicating take-out, or detachment, of a certain developing device through specifying the color of toner contained therein, before the certain developing device is moved to the developing-device take-out position, the data in the corresponding storage region is rewritten to "1", which is data indicating to start the movement to the developing-device take-out position. After the certain developing device has been taken out and a developing device with a proper toner color has been attached to the attachment position, the data "1" is rewritten back again to "0" through a signal indicating that the above processing actions have finished, such as a signal indicating that the power has been turned ON, as a result of, for example, closing an exterior cover.

Exchanging Developing Device

Figure 6:
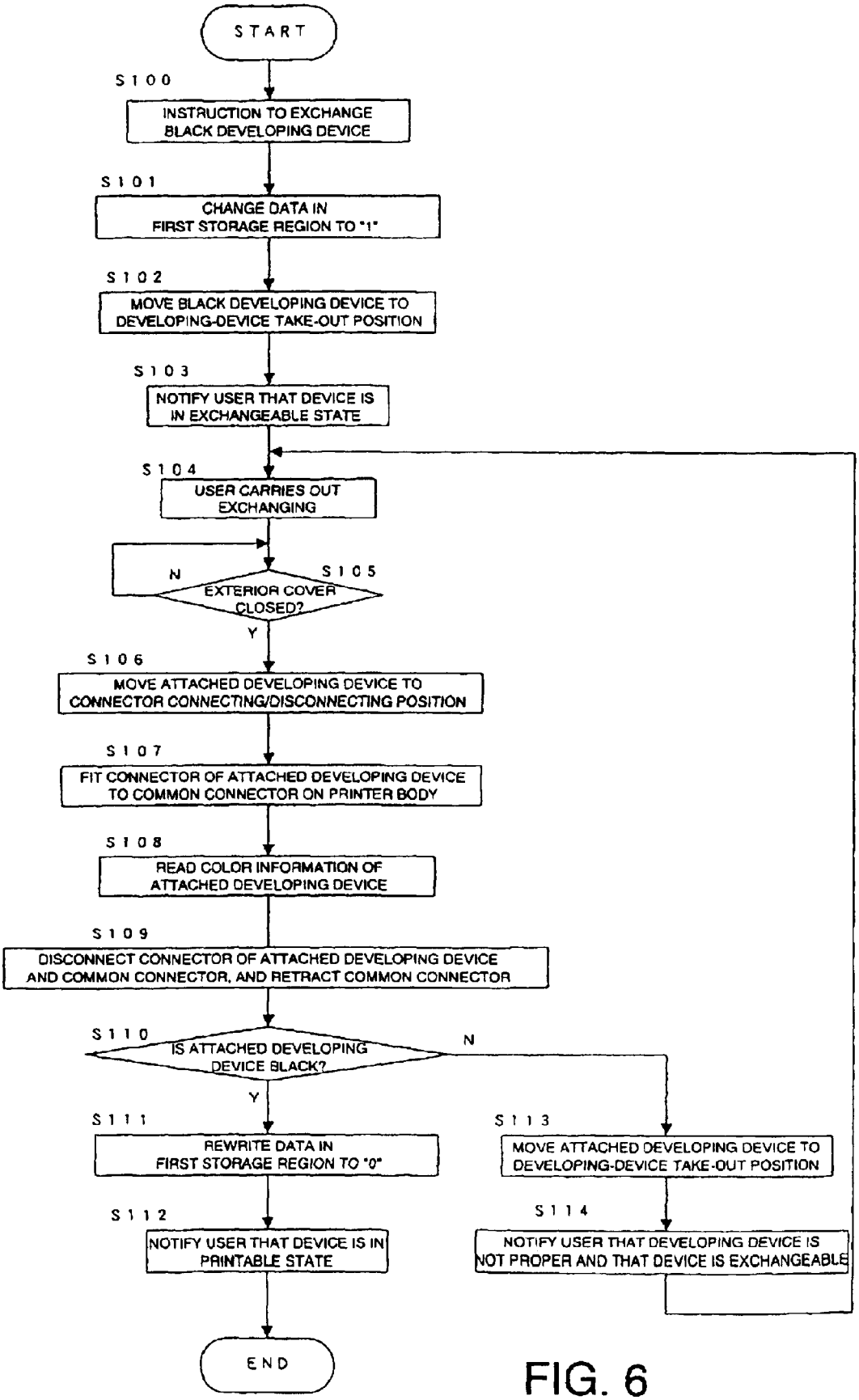
FIG. 6 is a flowchart showing exchanging operations of the black developing device.

Next, explanation will be made of exchanging a developing device in an image-forming apparatus structured as above. Here, as an example, explanation will be made of a case where the black developing device 51 is exchanged with reference to FIG. 6; however, this is the same for the other developing devices.

Exchanging of the black developing device 51 is carried out according to an exchange-instructing signal input by a user, for example, through input means provided on the present apparatus (i.e., the printer in this embodiment) or from a host device connected to the present apparatus. When the exchange-instructing signal for the black developing device 51 is input (S100), the unit controller 102 rewrites the data in the first storage region of the printer-body memory 122 from "0" to "1" (S101).

After the data in the first storage region is changed to "1", the unit controller 102 makes the YMCK developing unit 50 rotate, and moves and locates the black developing device 51 to the developing-device take-out position where it can be taken out (S102). Then, the displaying means 95 of the printer 10 and/or the host device connected to this apparatus (i.e., the printer in this embodiment) makes a notification that the black developing device 51 can be exchanged (S103).

When the user, having acknowledged this notification, opens the exterior cover of the printer 10, the high-voltage side of the power-supply line is shut off in cooperation with the opening of the cover, and the printer 10 is sent into the standby state so that the user can exchange the black developing device 51.

The user pulls the black developing device 51, arranged behind the take-out dedicated opening 37, out through the opening 37 and from the YMCK developing unit 50, and attaches a new developing device. When the user closes the exterior cover, the high-voltage side power that was shut-off is supplied again, and the printer 10 carries out processing to return to a printable state (S104, S105). Here, the unit controller 102: drives the stepper motor and makes the YMCK developing unit 50 rotate; moves the holder that holds the developing device, that has been attached, to the connector connecting/disconnecting position where its connector and the common connector 34 oppose (S106); makes these connectors fit together (S107); and reads data indicating toner-color information from the developing-device memory of the newly-attached developing device (S108). Then, the common connector 34 is retracted towards the printer body and pulled out from the connector of the developing device, and withdrawn to a position where it does not interfere with the rotational movement of the YMCK developing unit 50 (S109).

The data, read from the developing device that was attached, is determined by the unit controller 102 of whether it indicates black or not (S110). If the color information of the attached developing device is black, the unit controller 102 rewrites the data in the first storage region of the printer-body memory 122 from "1" to "0" (S111), and notifies the user, through the displaying unit 95, that exchanging operation has finished and printing operation is now possible (S112). On the other hand, if the toner-color information of the newly-attached developing device is not black, the unit controller 102 moves and locates the attached developing device to the developing-device take-out position (S113), and notifies the user, through the displaying unit 95 of the printer 10 or the host device, that the attached developing device is not proper, and that the developing device is now exchangeable (S114).

That is, the printer 10 itself has storage regions for storing the state regarding attachment of each developing device and made to correspond to each of the developing devices. And, when the user inputs an exchange-instruction signal instructing to exchange a developing device, the printer 10 stores, in the above-mentioned storage region, data "1" indicating an occurrence that the operation for detaching a certain developing device is to be started; and after detecting that a proper developing device has been attached, the printer rewrites the data in the storage region of the printer body to "0". Therefore, even if the power of the printer 10 is turned OFF, for example, during exchanging of a developing device, because of unexpected happenings, or the like, the state regarding attachment of each developing device at that time will be stored in the storage regions of the printer-body memory 122.

Therefore, according to the present printer 10, it becomes possible to confirm the state regarding attachment of the developing devices by the detachment data or the attachment data stored in the printer-body memory 122 provided on the printer body, even in a configuration where the unit controller 102 of the printer body cannot always communicate with the developing-device memory provided on each developing device. Further, the data in the printer-body memory 122 provided on the printer body not only indicates whether or not the developing devices 51, 52, 53, 54 are present, but also, it indicates that a developing device is attached only when a developing device with a proper color is attached to a proper position; therefore, there is no possibility that a printing operation will be carried out with a developing device of a wrong color being attached. Therefore, it becomes possible to prevent expendables such as toner, paper, and the like from being consumed by printing a defective image. Further, since it is possible to specify the color of the developing device that has not been attached, it becomes possible to carry out printing operations using the black toner if at least the black developing device is attached.

Further, for example, since it is possible to confirm the state regarding attachment of the developing devices without establishing electrical connection between the printer-body memory 122 and each of the developing devices 51, 52, 53, 54 each and every time and even when the power is turned ON, there will be no need to fit the connectors 51*b*, 52*b*, 53*b*, 54*b* of each developing device and the common connector 34 of the printer body together. Accordingly, since there is no need to rotate the YMCK developing unit 50 and locate every developing device at the connector connecting/disconnecting position, and since there is no need to fit the connectors and read-out the data in the developing device memories, it becomes possible to considerably reduce the initial-setup time when the power is turned ON and to bring the printer to a printable state in a short time. Further, since the frequency of fitting of the common connector 34 is considerably reduced, it becomes possible to reduce ware and damages of the common connector 34.

If it is necessary to write-in or read-out data, such as information relating to the amount of toner used (toner-usage-amount information) and the like, to/from the developing-device memory when the exchange-instruction signal for a developing device has been input, it is possible to drive the stepper motor and rotate the YMCK developing unit 50, move the relevant developing device to the connector connecting/disconnecting position, connect the connectors, and carry out a reading-out process or a write-in process of data to/from the developing device memory and/or the printer-body memory.

Further, if it is not possible to access the storage element of the developing device which is supposed to be held by a predetermined holder (for example, 55*a*), it is possible to notify this to the user through the displaying unit 95 of the printer 10 and/or the host device.

A program for executing the above-mentioned processes is stored in, for example, a ROM 124 shown in FIG. 2, and the program is executed by the CPU 120.

Operations upon Turning Power ON

Figure 7:
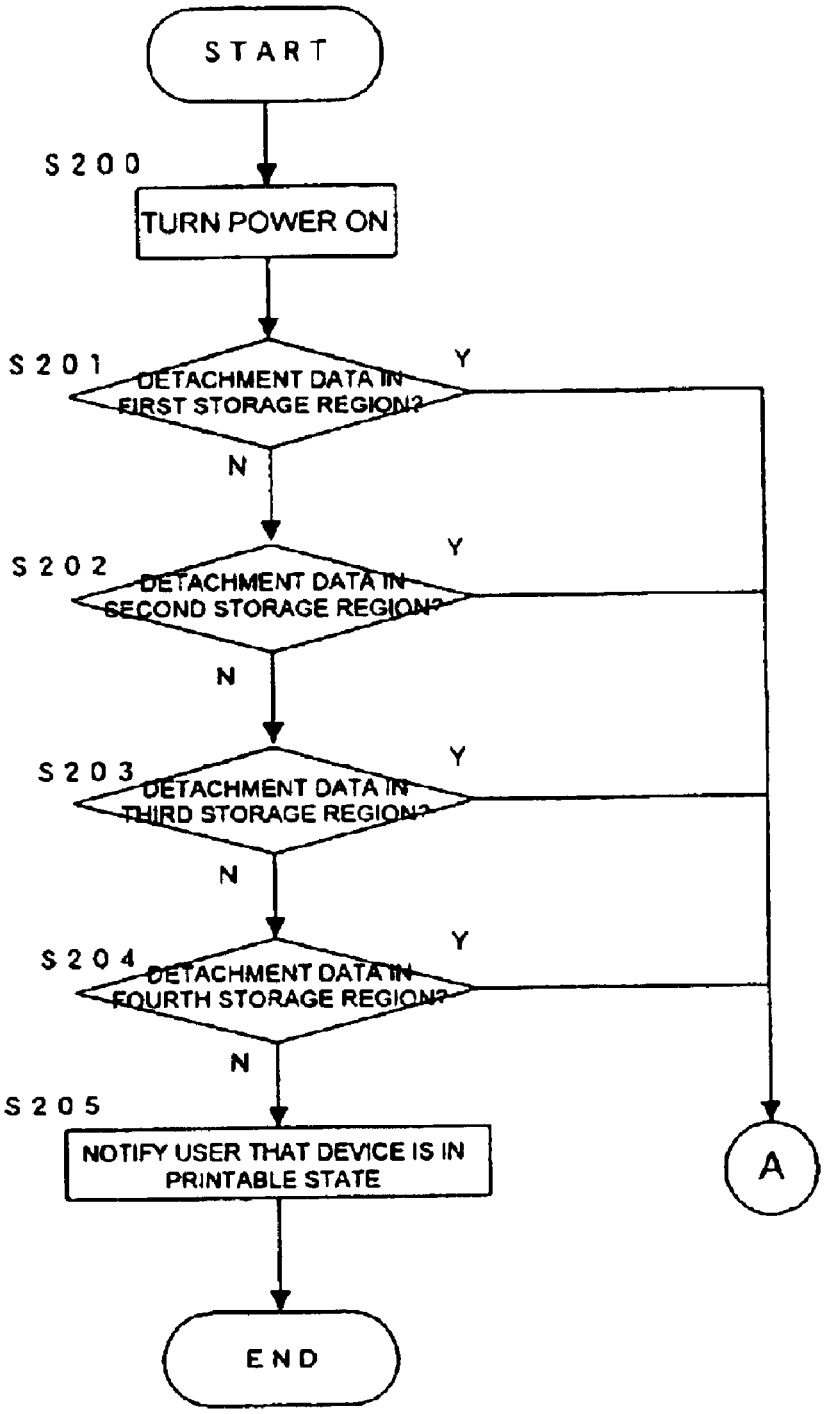
Figure 8:
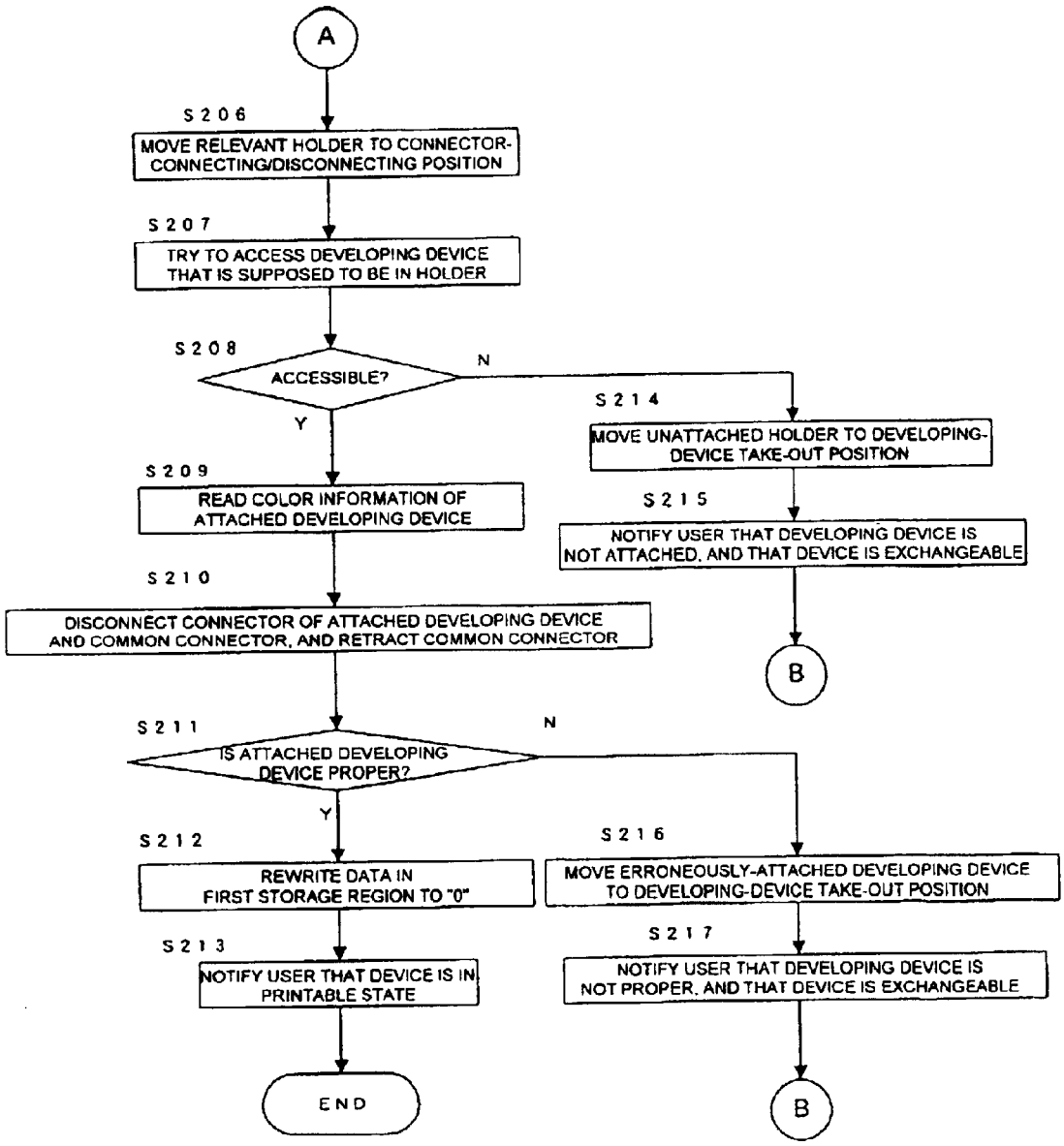
Figure 9:
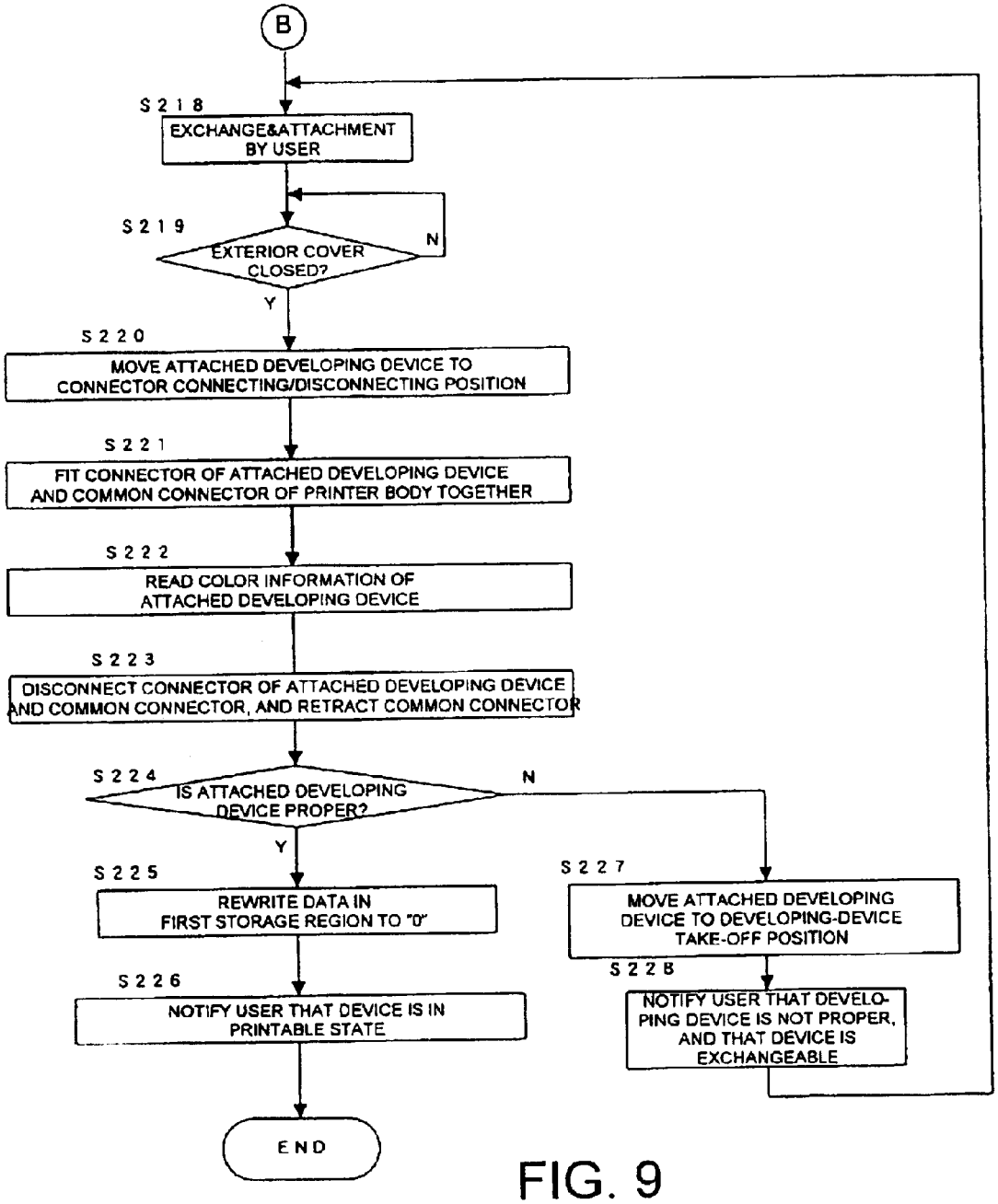
FIG. 9 is a flowchart showing operations in case the developing device having been attached is not proper.

Next, with reference to FIG. 7 through FIG. 9, explanation will be made of operations when the power is turned ON.

When the power is turned ON (S200), the unit controller 102 reads the data stored in the first-, second-, third-, and fourth storing regions of the printer-body memory 122 (S201 through S204).

If "0", i.e., attachment data is stored in all of the storage regions, the unit controller 102 carries out a predetermined initial operation and notifies the user, through the displaying unit 95 of the printer 10 and/or the host device, that it is ready to print (S205).

If "1", i.e., detachment data is stored in any one of the first-, second-, third-, and fourth storing regions, the unit controller 102 drives the stepper motor and rotates the YMCK developing unit 50, and moves the corresponding holder to the connector connecting/disconnecting position (S206). Here, explanation will be made of an example in which the detachment data is stored in the first storage region (that is, the storage region corresponding to the holder to which the black developing device is to be attached); however, although a different holder will be moved, similar operations will be carried out even if the detachment data is stored in another storage region.

At this connector connecting/disconnecting position, the common connector 34 is moved to make an attempt to fit the common connector 34 and the connector of the black developing device, which is supposed to be attached, together (S207). If the developing device is present in the corresponding holder, if its connector and the common connector 34 are fit together, and if it is possible to access the developing device memory of that developing device, the data indicating the toner-color information is read from the developing device memory (S208, S209). Then, the common connector 34 is retracted towards the printer body, pulled out from the connector of the developing device, and withdrawn to a position where it does not interfere with the rotational movement of the YMCK developing unit 50 (S210).

The data read from the attached developing device is determined by the unit controller 102 of whether it indicates black or not (S211). If the color information of the attached developing device is black, the unit controller 102 rewrites the data in the first storage region of the printer-body memory 122 from "1" to "0" (S212), and notifies the user, through the displaying unit 95, that exchanging operation has finished and printing operation is now possible (S213). On the other hand, if the toner-color information of the developing device being attached is not black, the unit controller 102 moves and locates the attached developing device to the developing-device take-out position (S216), and notifies the user, through the displaying unit 95 of the printer 10 and/or the host device, that the attached developing device is not proper, and that the developing device is now exchangeable (S217).

At this connector connecting/disconnecting position, an attempt to fit the common connector 34 and the connector of the black developing device that is supposed to be attached is carried out (S207). If access to the developing-device memory cannot be established, the unit controller 102 determines that the developing device is not attached; and the unit controller 102 moves and locates the corresponding holder to the developing-device take-out position (S214), and notifies the user, through the displaying unit 95 of the printer 10 and/or the host device, that the developing device is not attached, and that the developing device is now attachable (S215).

Then, similar to when the developing device is exchanged: the user attaches the developing device (S218, S219); the color information of the attached developing device is read (S220, S222); and when it is confirmed that the attached developing device is a black developing device (S224), the unit controller 102 rewrites the data in the first storage region of the printer-body memory 122 from "1" to "0" (S225); and it notifies the user, through the displaying unit 95, that the developing device has been attached and that printing operation is now possible (S226). If the toner-color information of the newly-attached developing is not black, the unit controller 102 moves the attached developing device to the developing-device take-out position (S227), and notifies the user, through the displaying unit 95 of the printer 10 and/or the host device, that the attached developing device is not proper, and that the developing device is now exchangeable (S228)

Therefore, according to the present printer 10, it becomes possible to confirm whether or not each developing device is attached by reading the data stored in each storage region of the printer-body memory 122, even in a configuration where the unit controller 102 of the printer body cannot always communicate with the developing-device memory provided on each developing device. That is, if there is no detachment data in the storage regions when the power is turned ON, it is possible to confirm that all of the developing devices are attached. Further, if detachment data is stored in a storage region, it can be recognized that there is a possibility that a developing device has been detached. In this case, an attempt is made to access the storage elements of each of the developing devices, and if all storage elements are accessible, it can be confirmed that all developing devices are attached; on the other hand, if there is a storage element that is not accessible, it becomes possible to recognize that there is a holder to which a developing device is not attached. Accordingly, it becomes possible to accurately confirm, for all developing devices, whether or not the developing device is attached.

Further, if there is no detachment data stored when the power is turned ON, since inspection of whether or not each developing device is attached will not be carried out, the time for a process to move the developing device and the time for the inspection process will be reduced, and it will become possible to bring the printer into a printable state in a short time.

Further, the printer-body memory 122 of the printer body does not only indicate whether or not the developing devices 51, 52, 53, 54 are attached, but it is also possible to specify the holders to which developing devices are attached or are not attached. Therefore, it becomes possible to prevent a circumstance in which developing devices held in two adjacent holders are detached.

For example, consider a state in which the data in each of the first through fourth storage regions are read when the power is turned ON, and detachment data is stored in either one of the regions. If the user further inputs an instruction signal to exchange another developing device, it is possible to determine whether or not the designated developing device to be exchanged is located in a holder next to that of an already-detached developing device.

Accordingly, if the developing device to be exchanged is held in the adjacent holder, the user is notified, through the displaying unit 95 of the printer 10 and/or the host device, that exchanging cannot be made. Therefore, it becomes possible to prevent developing devices held in two adjacent holders from being detached, and to prevent an extremely unbalanced load from being imparted on the stepper motor that drives the YMCK developing unit 50.

Further, since it is possible to specify the developing device that is not attached, it becomes possible to carry out printing using the black toner if the black developing device is attached.

Further, for example, since it is possible to confirm the state regarding attachment of the developing devices without establishing electrical connection between the printer-body memory 122 and each of the developing devices 51, 52, 53, 54 when the power is turned ON, there will be no need to fit the connectors 51*b*, 52*b*, 53*b*, 54*b* of each developing device and the common connector 34 of the printer body together. Accordingly, since there is no need to rotate the YMCK developing unit 50 and locate every developing device at the connector connecting/disconnecting position, and since there is no need to fit the connectors and read-out the data in the developing device memories, it becomes possible to considerably reduce the initial-setup time when the power is turned ON, and to bring the printer to a printable state in a short time. Further, since the frequency of fitting of the common connector 34 is considerably reduced, it becomes possible to reduce ware and damages of the common connector 34.

In the present embodiment, a method of accessing the developing-device memory was taken as a method for confirming whether or not the developing device is attached; however, other methods can be adopted, such as a method in which a protrusion or a reflector is provided on the developing device and a detector therefor is provided on the printer body, and the presence of the developing device is detected thereby.

Further, in the present embodiment, storage regions are respectively provided in correspondence with each of the holders. However, a configuration may be adopted in which a single storage region is provided in the printer-body memory, and the detachment data is stored in that storage region when any one of the developing devices is detached. In such a case, by making the shape of each developing device differ and making it so that the developing device can only be fit in a predetermined holder, it becomes possible to prevent a circumstance in which a developing device having an improper toner color is erroneously attached.

Therefore, there is no possibility that a printing operation will be carried out with a developing device having a wrong color being attached; and it becomes possible to prevent expendables such as toner, paper, and the like from being consumed by printing a defective image.

If it is necessary to write-in or read-out data, such as information relating to the amount of toner used (toner-usage-amount information) and the like, to/from the developing-device memory when the exchange-instruction signal for a developing device has been input, it is possible to drive the stepper motor and rotate the YMCK developing unit 50, move the relevant developing device to the connector connecting/disconnecting position, connect the connectors, and carry out a reading-out process or a write-in process of data to/from the developing-device memory and/or the printer-body memory.

A program for executing the above-mentioned processes is stored in, for example, a ROM 124 shown in FIG. 2, and the program is executed by the CPU 120.

Operations upon Initial Printer Operation

<Example of First Initial Operation>

Next, using FIG. 10 and FIG. 11, explanation will be made of an example of a first initial operation.

Figure 10:
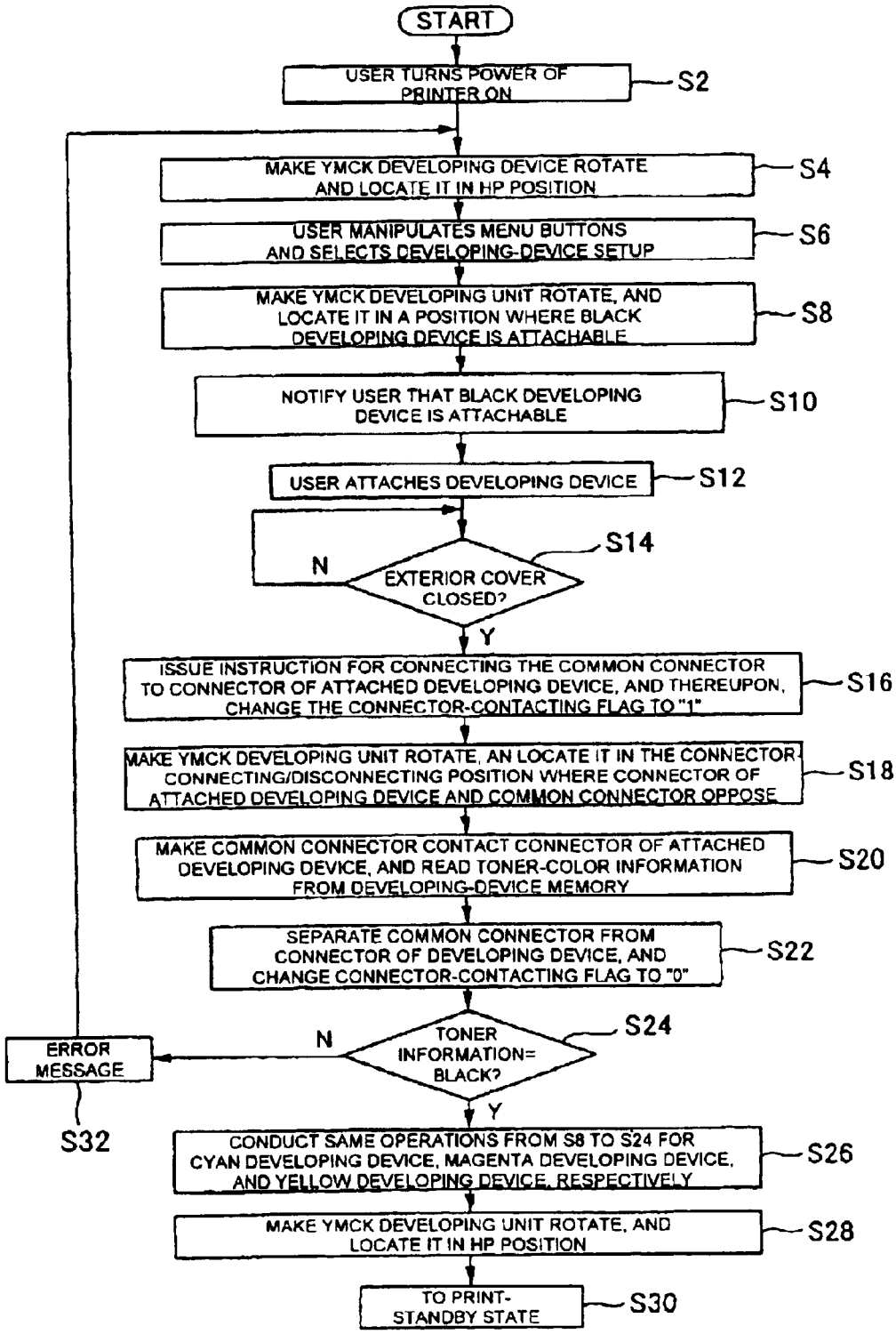
FIG. 10 is a flowchart for explaining an example of a first initial operation.
Figure 11:
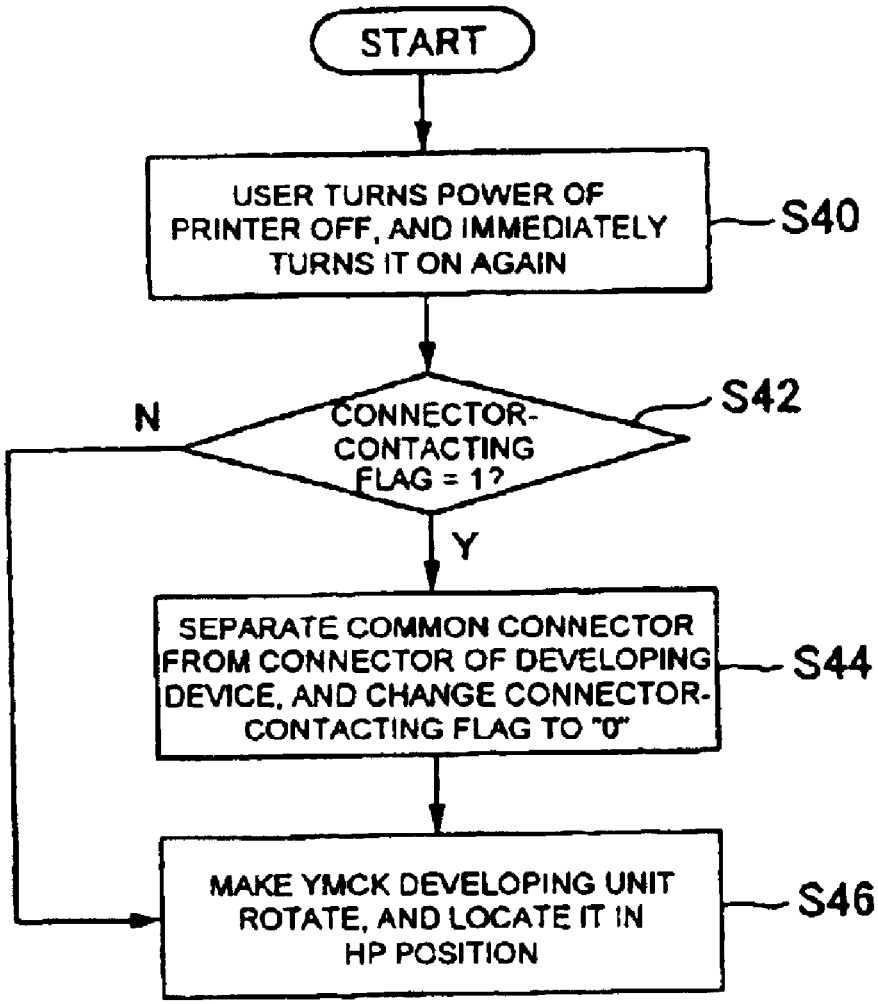
FIG. 11 is a flowchart for explaining an example of a first initial operation.

FIG. 10 and FIG. 11 are flowcharts for explaining an example of a first initial operation.

First, a user purchases a printer 10. The user turns the power of the printer 10 ON for supplying power thereto when, for example, the user uses the printer 10 for the first time (step S2).

The unit controller 102 detects that the power has been turned ON, controls the YMCK developing unit 50 with the YMCK-developing-unit drive-control circuit, makes the YMCK developing unit 50 rotate, and locates it in the HP position (step S4).

Then, by selecting a developing-device-setup command through manipulation of menu buttons provided on the displaying unit 95, the user instructs the printer 10 to perform a setup of the developing devices (step S6).

The unit controller 102 comprehends this command with the displaying-unit drive-control circuit. Then, by rotating the stepper motor from the HP position by a predetermined number of pulses, the unit controller 102 makes the YMCK developing unit 50 rotate further, and locates it in the developing-device attaching/detaching position (take-out position) so that attaching of a black developing device 51 is possible (step S8).

Then, the unit controller 102 controls the displaying unit 95 with the displaying-unit drive-control circuit, and notifies the user, through the displaying unit 95, that the black developing device 51 is now attachable (step S10).

When the user, having acknowledged the notification, opens the exterior cover of the printer 10, the high-voltage side of the power-supply line is shut off in cooperation with the opening of the cover, and the printer 10 is sent into the standby state so that the user can attach the black developing device 51. The user attaches the developing device to the YMCK developing unit 50 through the take-out dedicated opening 37 (step S12).

When the user closes the exterior cover, the high-voltage-side power that was shut-off is supplied again, and the printer 10 returns to a state in which the next process can be executed (step S14).

Next, in order to obtain later-explained information from the developing-device memory provided on the attached developing device, the unit controller 102 issues an instruction to move the common connector 34 provided on the printer body and to make the common connector 34 and the connector of the attached developing device contact each other. Here, the unit controller 102 stores, in the storage region of the printer-body memory 122, information indicating that both of the connectors are in contact with each other (step S16).

A storage region is established on the printer-body memory 122 of the unit controller 102. This storage region is for storing information indicating that the common connector 34 and the connector of the developing device are in contact with each other expressed as 1-bit, "0" or "1" data. In the present embodiment, the "0" or "1" information is referred to as a "connector-contacting flag". "1" is data indicating that the reading means and the developing device are in contact with each other; "0" is data indicating that the reading means and the developing device are separate from each other.

That is, the connector-contacting flag will be set to "1" when an instruction is issued to make the common connector 34 and the connector of the attached developing device contact each other.

Receiving this instruction, the drive-control circuit for the YMCK-developing-unit drives the stepper motor, makes the YMCK developing unit 50 rotate, and moves the attached developing device to the above-explained connector connecting/disconnecting position where the connector of the developing device and the common connector 34 oppose each other (step S18).

Next, the unit controller 102 moves the common connector 34 provided on the printer body, places the common connector 34 and the connector of the attached developing device in contact with each other, and reads the data that indicates toner-color information from the developing-device memory of the attached developing device (step S20).

Then, the unit controller 102 makes the common connector 34 retract towards the printer body. The common connector 34 is pulled-out and separated from the connector of the developing device. Here, the unit controller 102 changes the connector-contacting flag to "0" (step S22).

Then, a determination is made on whether the data indicating the toner-color information, that has been read at step S20, is indicative of black or not (step S24). If the data indicates black, the processes relating to attachment of the black developing device 51 is completed, and processes relating to attachment of the other developing devices will be carried out. In other words, operations similar to steps S8 through S24 will be carried out for the cyan developing device, the magenta developing device, and the yellow developing device, respectively (step S26).

If the data indicating the toner-color information does not indicate black, the unit controller 102 will control the displaying unit 95 with the displaying-unit drive-control circuit and will notify an error message to the user, prompting the user to restart the developing-device setup (step S32).

When attachment of all developing devices 51, 52, 53, 54 has completed, the unit controller 102 controls the YMCK developing unit 50 with the YMCK-developing-unit drive-control circuit, rotates the YMCK developing unit 50, and locates it in the HP position (step S28). Then, the printer 10 will be in a print-standby state (step S30).

Next, reference will be made to FIG. 11. FIG. 11 is a flowchart showing operations of the printer 10 carried out when the user erroneously turns the power of the printer 10 OFF and then turns the power of the printer ON again during the procedures shown in FIG. 10.

First, the user erroneously turns the power of the printer 10 OFF and then turns the power of the printer ON again during the procedures shown in FIG. 10 (step SAO).

The unit controller 102 detects that the power of the printer 10 has been turned ON, reads the connector-contacting flag stored in the storage region of the printer-body memory 122, and determines whether the connector-contacting flag is "1" or "0" (step S42).

If the flag is "1", the unit controller 102 determines that the common connector 34 and the connector of the developing device are in contact, separates the common connector 34 from the connector of the developing device, and changes the connector-connecting flag to "0" (step S44). Then, the unit controller 102 rotates the YMCK developing unit 50, and locates it in the HP position (step S46).

If the flag is "0", the unit controller 102 determines that the common connector 34 and the connector of the developing device are separated from each other, and rotates the YMCK developing unit 50 to locate it in the HP position, without carrying out the operations for separating the common connector 34 from the connector of the developing device (step S46).

A program for executing the above-mentioned processes is stored in a ROM provided in the unit controller 102, and the program is executed by the CPU 120.

Accordingly, by making the connectors, which are in contact with each other, separate when power is supplied to the printer, such as when the power of the printer is turned ON, it becomes possible to effectively prevent damages of the contacting sections of both of the connectors.

That is, as explained in the BACKGROUND OF THE INVENTION, assume a case where, for example, during a state where both of the connectors are in contact with each other, power supply to the printer is stopped, such as when a user erroneously turns the power of the printer OFF, and then power is supplied again to the printer, such as when the user turns the power of the printer ON again. In such a case, since the printer does not remember, or recorded, whether both of the connectors were in contact upon interruption in power supply, there is a possibility in that the printer will carry out an operation to move the YMCK developing unit, such as to move the YMCK developing unit to the HP position. Since the developing devices attached to the YMCK developing unit will also move according to the movement of the YMCK developing unit, the contacting sections of the mutually-contacting connectors may break.

In view of the above, when power is supplied to the printer, such as when the user turns the power of the printer ON, both of the connectors in contact are first separated from each other. Accordingly, it becomes possible to effectively prevent damages of the contacting sections of both of the connectors.

In the above-mentioned embodiment, it is stated that information indicating that both of the connectors are in contact is storable in the printer-body memory which serves as storing means that can keep information stored even when power supply to the printer is stopped, and if the above-mentioned information is stored when power is supplied to the printer, both of the connectors are separated from each other. However, it is possible to separate both of the connectors from each other every time power is supplied to the printer, without providing a printer-body memory in which information indicating that both of the connectors are in contact is storable.

However, the above-mentioned embodiment is more preferable in terms that it is possible to reduce the frequency of moving the stepper motor-for separating the connectors and to effectively reduce noise caused by the movement of the stepper motor, since the printer will try to separate both of the connectors from each other only when separation of the connectors is necessary.

Further, in the above-mentioned embodiment, it is stated that the information indicating that both of the connectors are in contact is stored in the printer-body memory when an instruction to make both of the connectors contact is issued; however, the configuration is not limited to the above. For example, a sensor for detecting whether both of the connectors are in contact with or separated from each other may be provided, and this information indicating that both of the connectors are in contact may be stored in, for example, the printer-body memory according to the information from the sensor.

However, the above-mentioned embodiment is more preferable in terms that there is no need to provide the above-mentioned sensor and that reduction in costs can be realized.

Further, it is possible to configure the printer so that a plurality of developing devices are attachable/detachable to/from the YMCK developing unit, and that the common connector and the connectors of the respective developing devices are separated from each other to a position in which the common connector does not interfere with the YMCK developing unit, nor with any of the plurality of developing devices attached to the YMCK developing unit.

Accordingly, it becomes possible to effectively prevent damages of not only the contacting sections of both of the connectors, but also other members of the printer.

Further, in the above-mentioned embodiment, both the above-mentioned connectors are separated from each other at the time power is supplied-to the printer, and the YMCK developing unit is moved to the HP position as an example of a predetermined initial position; however, the configuration is not limited to the above. For example, the operation of moving the YMCK developing unit to the HP position may be omitted.

However, the above-mentioned embodiment is more preferable in terms that, since the HP position can be taken as a reference position for determining a position for the YMCK developing unit to carry out the next process, it is possible to easily realize a printer achieving an effect of being able to effectively prevent damages on the contacting section of both the above-mentioned connectors.

Further, in the above-mentioned embodiment, the common connector is moved to place both of the connectors in contact or separate them; however, the configuration is not limited to the above. For example, the connectors of the developing devices may be moved, or both connectors may be moved.

However, the above-mentioned embodiment is more preferable in terms that it is possible to simplify the mechanism of the developing device, which tends to be produced in larger quantities compared to the printer body.

Further, in the above-mentioned embodiment, explanation was made taking the connector provided on the developing device as an example of a member which the common connector is made to contact; however, the configuration is not limited to the above, and it may be any member provided on the developing device. For example, the common connector may be made to directly contact the developing-device memory.

<Example of Second Initial Operation>

Next, using FIG. 12 and FIG. 13, explanation will be made of an example of a second initial operation.

Figure 12:
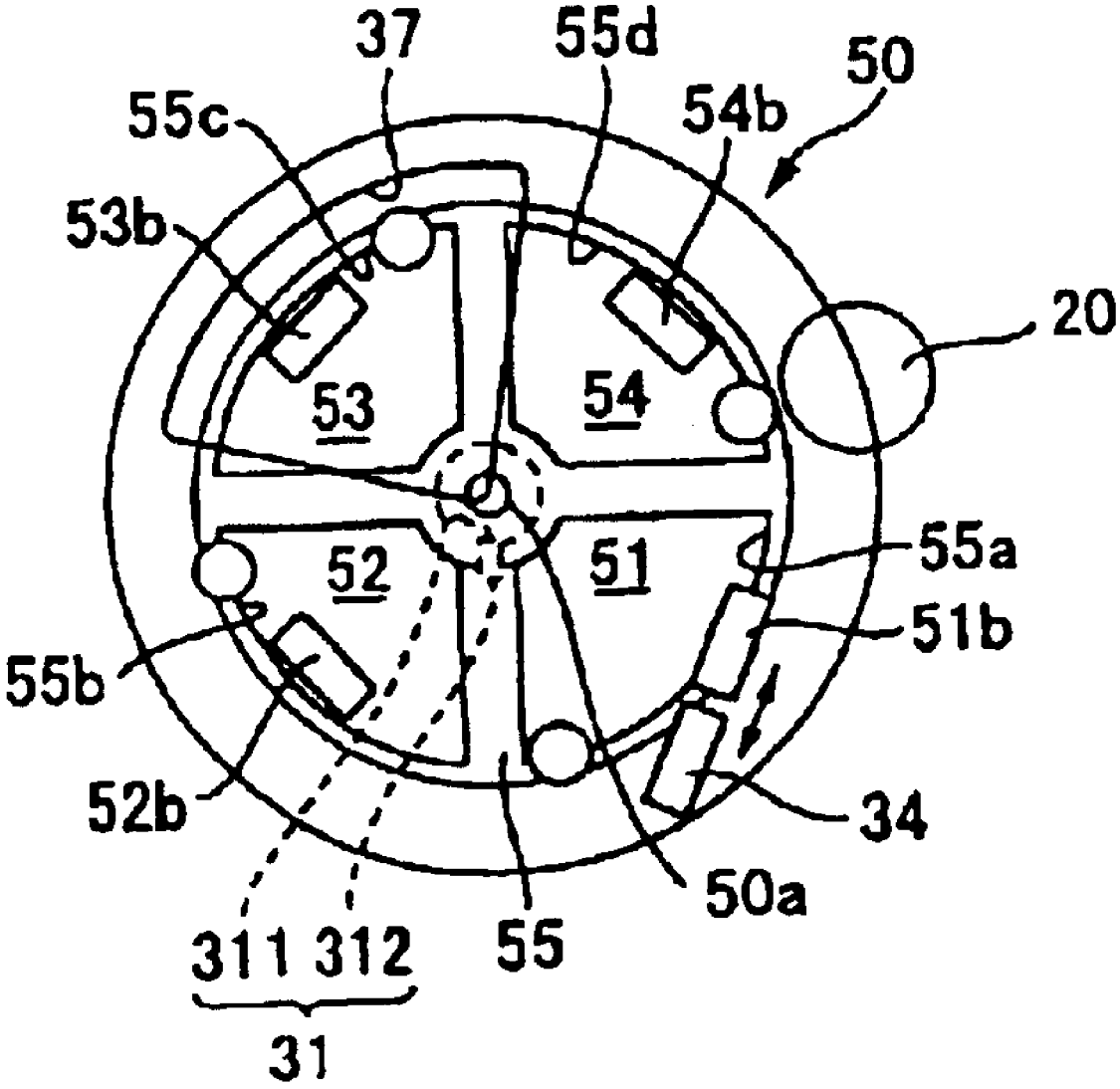
FIG. 12 is a schematic diagram showing a connector connecting/disconnecting position of a YMCK developing unit according to an example of a second initial operation.

FIG. 12 is a schematic diagram showing the connector connecting/disconnecting position of the YMCK developing unit according to an example of a second initial operation; FIG. 13 is a flowchart for explaining an example of a second initial operation.

First, focus is to be made on FIG. 12. This figure is such that corresponds to the connector connecting/disconnecting position of FIG. 4B already explained. As in FIG. 4B, this is the connector connecting/disconnecting position of the black developing device 51 that has been rotated from the HP position shown in FIG. 4A by the stepper motor by a predetermined number of pulses. At this connector connecting/disconnecting position, the connector 51*b* and the common connector 34 are arranged in a predetermined relative position, and these connectors can be placed in contact with or be separated from each other. The connector 51*b* is an example of sending means which is connected to storage means capable of storing various kinds of information, and which is for sending the information. The common connector 34 is an example of reading means for reading the above-mentioned information from the sending means.

That is, the common connector 34 is configured so as to be able to move towards and away from the black developing device 51, and moves towards the black developing device 51 when necessary Accordingly, the common connector 34 contacts the connector 51*b* of the black developing device 51, and the developing-device memory 51*a* provided on the black developing device 51 is electrically connected to the unit controller 102 of the controlling unit 100; thus, data is transferred therebetween.

On the contrary, the common connector 34 moves away from the black developing device 51 from a state in which the common connector 34 and the connector 51*b* of the black developing device 51 are in contact. Accordingly, the common connector 34 is separated from the connector 51*b* of the black developing device 51.

In comparing FIG. 12 with FIG. 4B, the positioning of the common connector 34 and the connector 51*b* is different. That is, the connector 51*b* and the common connector 34 are arranged so that the moving direction of the common connector 34, which is moved to contact the connector 51*b*, is made to match the moving direction of the connector 51*b* which is moved with the rotation of the YMCK developing unit 50. Note that the above-mentioned moving direction is shown by the arrow in FIG. 12.

Figure 13:
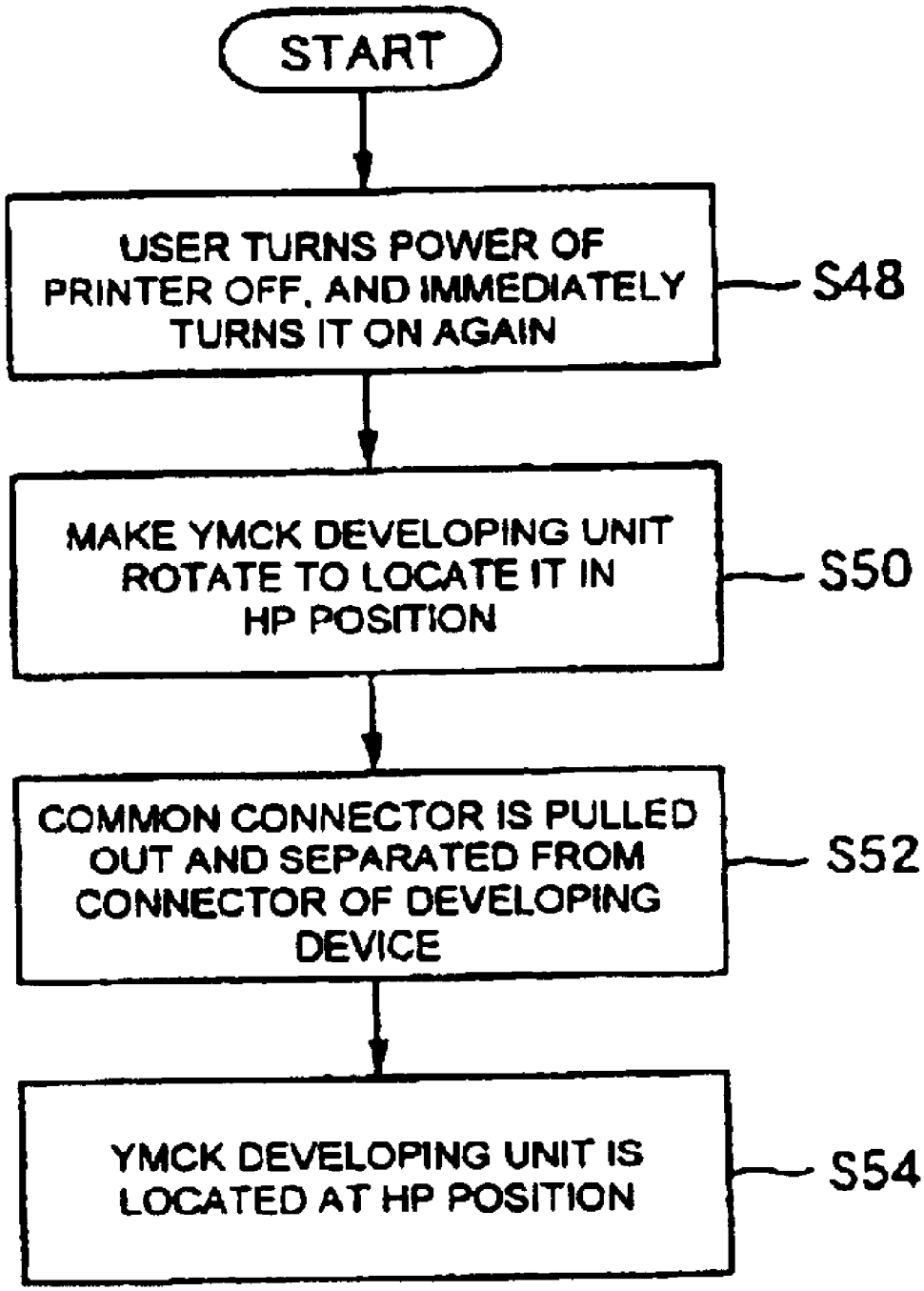
FIG. 13 is a flowchart for explaining an example of a second-initial operation.
Figure 14:
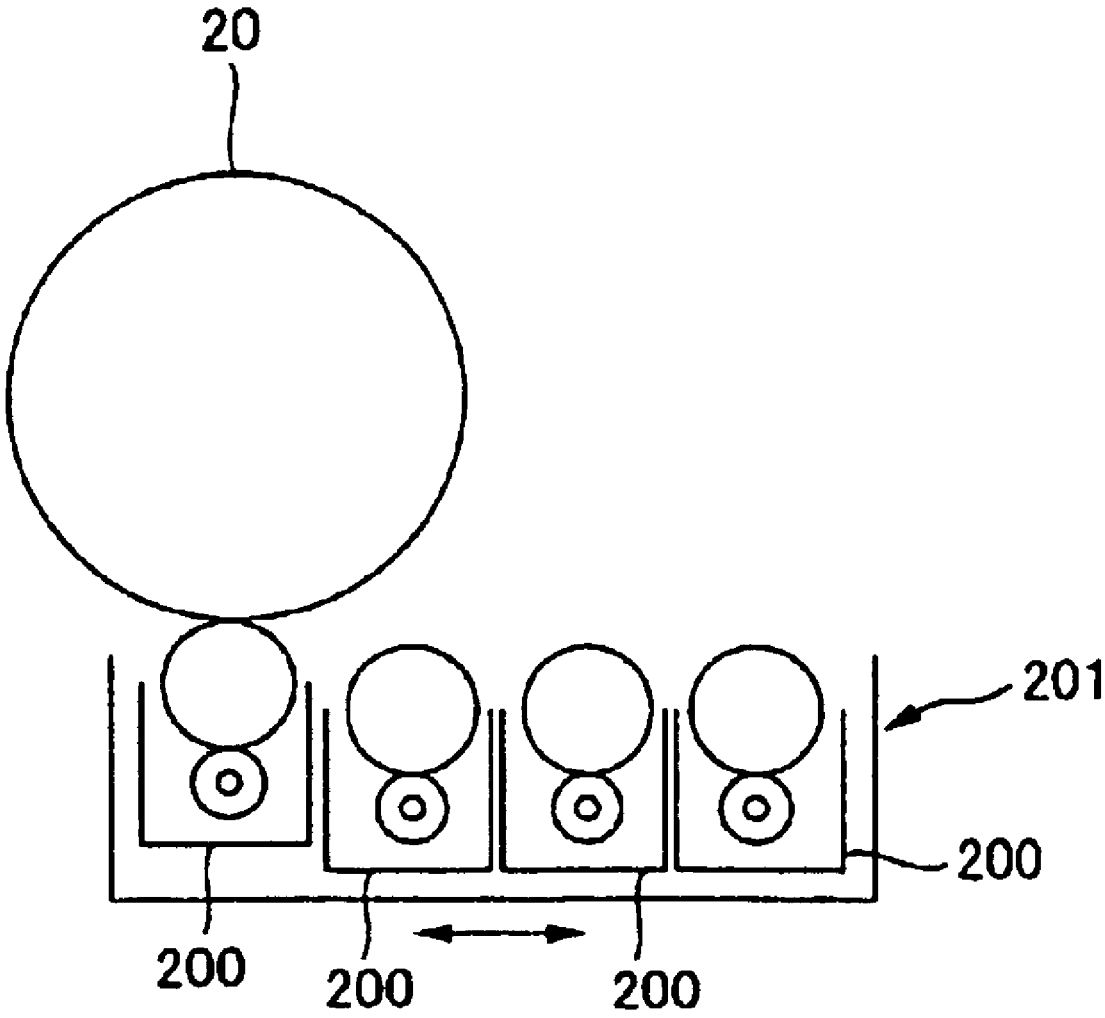
FIG. 14 is a conceptual diagram showing slide-type developing devices.

Next, focus is to be made on FIG. 13. This figure is such that corresponds to FIG. 11 already explained, and is a flowchart showing operations of the printer 10 when a user erroneously turns the power of the printer 10 OFF and then turns the power of the printer 10 ON again during the procedures shown in FIG. 10. Note that, in the present embodiment, the procedures relating to the connector-contacting flag (i.e., the procedure of setting the connector-contacting flag to "1" in S16 and the procedure of setting the connector-contacting flag to "0" in S22 of FIG. 10) do not exist among the procedures shown in FIG. 10.

First, the user erroneously turns the power of the printer 10 OFF and then turns the power of the printer 10 ON again during the procedures shown in FIG. 10 (step S48).

As already explained, since the procedures relating to the connector-contacting flag do not exist in the present example, the unit controller 102 detects that the power of the printer 10 has been turned ON, and rotates the YMCK developing unit 50 to located it in the HP position (step S50).

Here, since the connector 51*b* and the common connector 34 are arranged so that the moving direction of the common connector 34, which is moved to contact the connector 51*b*, is made to match the moving direction of the connector 51*b* which is moved with the rotation of the YMCK developing unit 50, the common connector 34 is pulled out of and separated from the connector 51*b* (step S52).

Then, the YMCK developing unit 50 is finally located in the HP position (step S54).

Accordingly, by the connector 51*b* and the common connector 34 being arranged so that the moving direction of the common connector 34, which is moved to contact the connector 51*b*, is made to match the moving direction of the connector 51*b* which is moved with the rotation of the YMCK developing unit 50, it becomes possible to effectively prevent damages of the contacting sections of both of the connectors.

In the above example, explanation was made of procedures taken by the user for carrying out a setup of the developing devices to the printer, such as when the user purchases a printer and uses it for the first time. However, the procedure is not limited to this example; and the procedure may include a process in which various kinds of information is read from the developing device by making the reading means and the developing device contact each other.

A computer program in the above explanation may be recorded on a computer-readable storage medium such as a floppy disk, a CD-ROM, and the like.

Other Embodiments

Above, explanation was made of an image-forming apparatus etc. according to the present invention based on one embodiment. However, the above-mentioned embodiment of the invention is an example for facilitating understanding of the present invention, and is not to limit the present invention. It is without saying that the present invention may be altered and/or modified without departing from the scope thereof, and that the present invention includes its equivalents.

In the above-explained embodiment, explanation was made of a full-color laser-beam printer of the intermediate-transferring type as an example of an image-forming apparatus. However, the present invention is applicable to various image-forming apparatuses such as full-color laser-beam printers other than the intermediate-transferring type, single-color laser-beam printers, photocopiers, facsimile machines, and the like.

Further, in the above-explained embodiment, explanation was made of a printer comprising a rotary-type developing portion in which the YMCK developing unit rotates and each of the developing devices selectively oppose the photoconductor. However, the printer is not limited to the above; and any structure may be adopted as long as a plurality of developing devices move and selectively oppose a photoconductor, and the printer body and the developing device can be electrically connected when necessary, such as a type in which developing devices are arranged in parallel and slide.

Further, the photoconductor does not have to be limited to the so-called photoconductive roller structured by providing a photoconductive layer on the outer peripheral surface of a cylindrical, conductive base; but it can be a so-called photoconductive belt structured by providing a photoconductive layer on a surface of a belt-like conductive base.

Further, in the above-mentioned embodiment, explanation was made of an example where the developing devices are in the four colors of black, magenta, cyan, and yellow. However, the number of developing devices does not have to be limited to four, but the number can be either larger or smaller.

Further, it is possible to realize a computer system comprising: the image-forming apparatus according to the above-explained embodiment; a computer; a display device such as a CRT; and an input device such as a mouse or a keyboard. In a computer system realized as above, the system, as a whole, will be superior to a usual system.

According to the present embodiment, it becomes possible to realize an image-forming apparatus etc. making it possible to know whether or not all of the developing devices are attached when, for example, the power of the apparatus is turned ON, without constantly connecting the apparatus body and each of the developing devices.

Further, according to the present embodiment, it becomes possible to realize an image-forming apparatus etc. that can effectively prevent damages of structural members.

What is claimed is:

1. An image-forming apparatus comprising:

an image carrier on which a latent image is formed; and a plurality of holders for detachably holding a plurality of developing devices, respectively; said developing devices developing said latent image formed on said image carrier with toner having colors that differ from each other wherein:

said image-forming apparatus further comprises:

inspecting means capable of performing an inspection of whether or not said developing device is attached to said holder when said inspecting means is arranged in a predetermined relative position in view of each of said holders, and a nonvolatile rewritable storage region in which detachment data indicating an occurrence of detachment of said developing device is stored when said developing device is detached from said holder; and if said detachment data is stored in said storage region when power of said image-forming apparatus is turned ON, said holder and said inspecting means are arranged in said relative position, and inspection is performed of whether or not said developing device is attached.

2. An image-forming apparatus according to claim 1, wherein if said inspecting means determines that said developing device is attached, said detachment data is rewritten to attachment data indicating that said developing device is attached.

3. An image-forming apparatus according to claim 1, wherein:

said image-forming apparatus further comprises notifying means that generates a notification signal when an occurrence to be notified to a user takes place, and that makes a notice of this occurrence according to said notification signal; and if said inspecting means determines that said developing device is not attached, a notification signal for prompting attachment of said developing device is generated.

4. An image-forming apparatus according to claim 1, wherein:

black toner is contained in one of said plurality of developing devices;

said storage region is provided for each of said colors of said toner contained in each of said developing devices held by corresponding ones of said holders; and if said detachment data is stored in a storage region that corresponds to a color other than black, an image-forming operation using said black toner is made possible.

5. An image-forming apparatus according to claim 1, wherein:

said inspecting means comprises accessing means capable of accessing a storage element provided on said developing device; and said inspection of whether or not said developing device is attached is performed by determining whether or not said accessing means can access said storage element.

6. An image-forming apparatus according to claim 1, wherein:

a plurality of said storage regions are provided corresponding to each of said holders; and if said detachment data is stored in any one of said storage regions when power of said image-forming apparatus is turned ON, inspection is performed of whether or not said developing device is attached in respect to said holder corresponding to said storage region storing said detachment data.

7. An image-forming apparatus according to claim 1, wherein:

four of said holders are provided at equiangular intervals about an axis of circular ent;

a plurality of said storage regions are provided corresponding to each of said holders; and if said detachment data is stored in any one of said storage regions when power of said image-forming apparatus is turned ON, inspection is performed of whether or not said developing device is attached in respect to said holder corresponding to said storage region storing said detachment data, and if it is determined that said developing device is not attached, detaching of a developing device that is attached to a holder adjacent to said holder, to which said developing device is not attached, is forbidden.

8. An image-forming apparatus according to claim 1, wherein:

said image-forming apparatus further comprises:

an inspector capable of performing an inspection of whether or not said developing device is attached to said holder when said inspector is arranged in a predetermined relative position in view of each of said holders, and a nonvolatile rewritable storage region in which detachment data indicating an occurrence of detachment of said developing device is stored when said developing device is detached from said holder; and if said detachment data is stored in said storage region when power of said image-forming apparatus is turned ON, said holder and said inspector are arranged in said relative position, and inspection is performed of whether or not said developing device is attached.

9. The image-forming apparatus of claim 1, wherein at least one of the plurality of developing devices includes a developing roller.

10. A computer-readable storage medium having a program recorded thereon, said program making an image-forming apparatus operate, said image-forming apparatus comprising:

an image carrier on which a latent image is formed; and a plurality of holders for detachably holding a plurality of developing devices, respectively; said developing devices developing the latent image formed on said image carrier with toner having colors that differ from each other wherein:

said image-forming apparatus further comprises:

inspecting means capable of performing an inspection of whether or not said developing device is attached to said holder when said inspecting means is arranged in a predetermined relative position in view of each of said holders, and a nonvolatile rewritable storage region in which detachment data indicating an occurrence of detachment of said developing device is stored when said developing device is detached from said holder; and if said detachment data is stored in said storage region when power of said image-forming apparatus is turned ON, said holder and said inspecting means are arranged in said relative position, and inspection is performed of whether or not said developing device is attached.

11. A computer system comprising:

a computer; and an image-forming apparatus that can be connected to said computer, said image-forming apparatus comprising:

an image carrier on which a latent image is formed; and a plurality of holders for detachably holding a plurality of developing devices, respectively; said developing devices developing the latent image formed on said image carrier with toner having colors that differ from each other wherein:

said image-forming apparatus further comprises:

inspecting means capable of performing an inspection of whether or not said developing device is attached to said holder when said inspecting means is arranged in a predetermined relative position in view of each of said holders, and a nonvolatile rewritable storage region in which detachment data indicating an occurrence of detachment of said developing device is stored when said developing device is detached from said holder; and if said detachment data is stored in said storage region when power of said image-forming apparatus is turned ON, said holder and said inspecting means are arranged in said relative position, and inspection is performed of whether or not said developing device is attached.

* * * * *